US005852762A

United States Patent [19]

Hatta et al.

[11] Patent Number: 5,852,762

[45] Date of Patent: Dec. 22, 1998

[54] TONER MAGAZINE AND CLEANER FOR AN ELECTROPHOTOGRAPHIC APPARATUS

[75] Inventors: Hirotaka Hatta, Ebina; Shigemi Kanda, Atsugi, both of Japan

[73] Assignee: Ricoh Company, Ltd., Tokyo, Japan

[21] Appl. No.: 904,690

[22] Filed: Aug. 1, 1997

Related U.S. Application Data

[63] Continuation-in-part of Ser. No. 802,878, Feb. 19, 1997, which is a continuation of Ser. No. 672,039, Jun. 26, 1996, Pat. No. 5,697,038, which is a continuation of Ser. No. 177,318, Jan. 4, 1994, Pat. No. 5,555,081.

[30] Foreign Application Priority Data

| | | | |
|---|---|---|---|
| Jan. 12, 1993 | [JP] | Japan | 5-003435 |
| Mar. 2, 1993 | [JP] | Japan | 5-041246 |
| Oct. 27, 1993 | [JP] | Japan | 5-269019 |
| Aug. 2, 1996 | [JP] | Japan | 8-204806 |
| May 14, 1997 | [JP] | Japan | 9-124310 |

[51] Int. Cl.[6] ..... G03G 21/10

[52] U.S. Cl. ..... 399/358; 399/262

[58] Field of Search ..... 399/35, 120, 123, 399/119, 258, 262, 263, 358, 98, 102, 103, 105

[56] References Cited

U.S. PATENT DOCUMENTS

| | | | |
|---|---|---|---|
| 4,850,303 | 7/1989 | Cipolla et al. . | |
| 4,899,690 | 2/1990 | Hacknauer et al. . | |
| 5,126,799 | 6/1992 | Matsuura et al. . | |
| 5,170,212 | 12/1992 | DeCecca | 399/103 |
| 5,488,462 | 1/1996 | Ishikawa et al. | 399/103 |
| 5,592,268 | 1/1997 | Uehara et al. | 399/103 X |

FOREIGN PATENT DOCUMENTS

| | | |
|---|---|---|
| 61-185070 | 11/1986 | Japan . |
| 3-256058 | 11/1991 | Japan . |

*Primary Examiner*—S. Lee

*Attorney, Agent, or Firm*—Oblon, Spivak, McClelland, Maier & Neustadt, P.C.

[57] ABSTRACT

A toner magazine for feeding a developing device including in an electrophotographic apparatus, and a cleaner and toner magazine (CTM) including a cleaning unit and a developing unit are disclosed. The cleaning unit has a cleaning blade for removing toner remaining on a photoconductive element and collecting it as waste toner. The developing unit has a fresh toner tank for storing fresh toner. The toner magazine and CTM are easy to handle and facilitate replacement and maintenance. The fresh toner tank is capable of storing a great amount of toner therein without increasing the overall size of the toner magazine and CTM. The toner magazine and CTM can be recycled by a simple procedure and reduce the amount of a seal material used to prevent the toner from leaking.

23 Claims, 17 Drawing Sheets

TONER MAGAZINE AND CLEANER FOR AN ELECTROPHOTOGRAPHIC APPARATUS

This application is a continuation-in-part of U.S. application Ser. No. 08/802,878, filed February 1997.

BACKGROUND OF THE INVENTION

The present invention relates to a cleaning device and a developing device incorporated in a facsimile apparatus, printer or similar electrophotographic apparatus. More particularly, the present invention is concerned with a toner magazine for feeding fresh toner to a developing device, and a cleaner and toner magazine (CTM hereinafter) having a cleaning unit and a developing unit constructed integrally with each other. The cleaning unit has a cleaning blade for removing toner left on a photoconductive element after image transfer, and a waste toner tank for collecting it, while the developing unit has a fresh toner tank storing fresh toner.

It is a common practice with an electrophotographic apparatus to form a latent image electrostatically on an image carrier, e.g., photoconductive element, develops the latent image with a developer, i.e., toner to produce a corresponding toner image, and then transfer the toner image to a paper. The paper has the toner image fixed by heat and then driven out of the apparatus as a recording. The toner left on the photoconductive element after the image transfer is scraped off by a cleaning blade and then collected in a waste toner tank. A discharge lamp illuminates the cleaned surface of the photoconductive element to dissipate charges also left on the element. The current trend in the electrophotographic apparatuses art is toward user-oriented maintenance including replenishment of fresh toner and the collection of waste toner. For this purpose, the manipulation for maintenance should be simplified. However, a fresh toner tank and the waste toner tank have customarily been constructed separately from each other, forcing the user to replace them one by one by a troublesome procedure. Further, in the conventional apparatus, the waste toner tank has to be provided with a sensor responsive to a condition wherein the tank has been filled up with the waste toner.

To eliminate the above problems, there has been proposed a system in which the photoconductive element, developing device, fresh toner tank, cleaning device and waste toner tank are constructed into a unit or process cartridge; when, for example, the fresh toner tank runs out of toner, the unit or process cartridge is bodily replaced. This, however, increases the cost of the process cartridge as well as the running cost for a single paper because, for example, the photoconductive element, developing device, cleaning device and waste toner tank which are still usable have to be discarded together with the empty fresh toner tank. Moreover, toxic substances are contained in the process cartridge and apt to invite environmental pollution when the cartridge is discarded. Although the manufacture may collect and refill the fresh toner tank, even the photoconductive element, developing device, cleaning device and waste toner tank not directly contributing to toner replenishment have to be transported, resulting in an extra transport cost.

In the light of the above, there has also been proposed a CTM in which the fresh toner tank and waste toner tank are constructed integrally with each other. The CTM, which is bodily replaceable, simplifies maintenance, eliminates the need for the sensor responsive to the full state of the waste toner tank, and solves the environmental pollution problem. In the conventional CTM, the fresh toner tank is fully independent of the developing device and replenishes it with toner via a long transport path implemented by a motor, screw, guide, agitator, etc.

With an electrophotographic apparatus using such a CTM, the user is expected to perform maintenance including the replenishment of fresh toner and the collection of waste toner. It is therefore preferable that the manipulation for maintenance be simple, and the frequency of replacement of the CTM be low. To reduce the frequency of replacement, each of the fresh toner tank and waste toner tank should advantageously be provided with a great capacity. However, such bulky tanks are disadvantageous from a space saving standpoint. Further, the fresh toner tank run out of toner simply wastes the space, and in addition degrades cost performance of the apparatus because it is made up of a number of members for effecting efficient replenishment. Moreover, because the toner is transported over a long transport path, the quality thereof and therefore image quality is apt to fall.

Today, recycling various parts constituting the electrophotographic apparatus and reusing them is one of social problems. There is an increasing demand for a simple procedure for recycling the CTM which is one of the parts capable of being recycled. To recycle the CTM, the waste toner tank, fresh toner tank and toner magazine are disassembled in a preselected order. After the inside of the individual toner tank and that of the toner magazine, as well as the individual constituent part, have been cleaned, expendable supplies reached their lives are replaced. Then, the CTM is again assembled for reuse, and the toner magazine is filled with fresh toner. The problem with this procedure is that the toner magazine has a greater number of parts and a more complicated structure than the waste toner tank and needs a number of disassembling and assembling steps. In the conventional toner magazine, the fresh toner tank is made up of two or more separable parts. At the time of recycling, the parts constituting the fresh toner tank are separated in order to expose the inside of the tank. In this condition, an agitator and other members are removed from the fresh toner tank. The fresh toner tank with this configuration provides, when separated, an opening broad enough for the operator to disassemble and clean the tank easily.

However, when the fresh toner tank has its opening broadened, the joint between the parts constituting the tank necessarily increases in length and is apt to cause the toner to leak therethrough. It is a common practice to insert a sponge seal or similar throwaway seal material in the joint between the parts of the fresh toner tank. However, because the joint is long, the amount of the throwaway seal material to be used increases. This, coupled wit the fact that the sealing operation is time-consuming, lowers payability as to the recycling of the toner magazine.

Various methods for inserting the seal material in the joint between the parts of the fresh toner tank as simply as possible and peeling it from the parts have been proposed in the past. Even with such methods, it is impracticable to sufficiently improve the maneuverability because a seal member of particular kind is applied to each part of the fresh toner tank by a particular method. In addition, the increase in the amount of the throwaway seal material is not desirable from the recycling standpoint.

On the other hand, an electrophotographic apparatus of the type described is practicable with one of two different charging methods, i.e., a corona charging method and a contact charging method. The corona charging method, which uses a corona charger, is predominant today because it is capable of charging the photoconductive element uniformly over a long period of time. By contrast, the contact charging method holds a charger in contact with the photoconductive element. This kind of method is susceptible to the contact condition of the charger with the photoconductive element and the surface condition of the element. With the contact charging method, therefore, it is difficult to charge the photoconductive element uniformly over a long period of time. For example, it is likely that toner particles, paper dust and other impurities deposited on the photoconductive element are transferred to the charger, e.g., charge roller, lowering the charging ability of the charger due to contamination.

However, the contact charger is advantageous over the corona charger in that it produces a minimum of ozone during operation, and in that it is operable with a low voltage. The reduction of ozone, among others, meets the increasing demand for improved office environments. For this reason, the increase in the cost of equipment to be operated in offices is generally accepted. In this situation, the prerequisite is that the contact charger be replaced periodically, and that the deterioration of such a charger due to aging be slowed down.

SUMMARY OF THE INVENTION

It is, therefore, an object of the present invention to provide a toner magazine and a CTM easy to replace and handle and facilitating maintenance.

It is another object of the present invention to provide a toner magazine and a CTM providing a fresh toner tank with a great capacity.

It is another object of the present invention to provide a toner magazine and a CTM having a simple construction, increasing the size of a fresh toner tank, reducing the overall size, and saving space.

It is another object of the present invention to provide a toner magazine and a CTM which can be mounted to and positioned on an electrophotographic apparatus with ease.

It is another object of the present invention to provide a toner magazine and a CTM constructed integrally with a contact charger and slowing down the fall of the ability of the charger.

It is another object of the present invention to provide a toner magazine and a CTM promoting stable and sure collection of remaining toner over a long period of time.

It is another object of the present invention to provide a toner magazine and a CTM capable of promoting easy recycling and reducing the amount of a seal material to be used for preventing a developer from leaking.

In accordance with the present invention, a CTM for replenishing a developing device of an electrophotographic apparatus with a toner of the present invention comprises a waste toner tank for removing a toner left on a photoconductive element of the electrophotographic apparatus after image transfer and collecting the toner, a fresh toner tank constructed integrally with the waste toner tank for replenishing the developing device with a fresh toner, and a connecting mechanism for connecting the waste toner tank and fresh toner tank such that the fresh toner tank is movable to the developing device.

Also, in accordance with the present invention, a toner magazine removably mounted to an electrophotographic apparatus includes a developer storing body storing a developer therein An agitating member is disposed in the developer storing body and mounted on a single rotatable shaft in the developer storing body. The agitating member is rotated by a driving force transmitted to the shaft from the outside of the developer storing body, while agitating the developer. A first hole is formed in the region of the developer storing body containing one point where the developer storing body intersects the center line of the shaft, The first hole is so configured as to allow the agitating member to pass therethrough along the center line of the shaft. A first cap member is removably fitted in the first hole for restricting the movement of the agitating member along the center line of the shaft when fitted, or allowing the agitating member to move along the center of the shaft when removed.

Further, in accordance with the present invention, a toner magazine removably mounted to an electrophotographic apparatus includes a developer storing body storing a developer therein. An agitating member is disposed in the developer storing body and mounted on a single rotatable shaft in the developer storing body. The agitating member is rotated by a driving force transmitted to the shaft from the outside of the developer storing body, while agitating the developer. A first hole is formed in the region of the developer storing body containing one point where the developer storing body intersects the center line of the shaft. The first hole is so configured as to allow the agitating member to pass therethrough along the center line of the shaft. A second hole is formed in the region of the developer storing body containing the other point where the developer storing body intersects the center line of the shaft. A hollow cylindrical cap mounting portion is formed at the end of the developer storing member around the first hole and formed with a male screw on the outer circumference thereof. A first cap member in the form of a cap nut is formed with a female screw engageable with the male screw in the inner circumference thereof. The first cap member seals the first hole when mounted to the cap mounting portion or uncovers the first hole when removed from the cap mounting portion. A second cap is mounted on the end of the shaft remote from the first hole for sealing the second hold when inserted into the second hole from the inside of the developer storing body.

Moreover, in accordance with the present invention, a CTM removably mounted to an electrophotographic apparatus includes a toner magazine storing a developer therein and for feeding the developer to a developing device included in the electrophotographic apparatus for developing a latent image electrostatically formed on a photoconductive element. A waste toner tank is constructed integrally with the toner magazine for collecting the developer removed from the photoconductive element. The toner magazine includes a developer storing body storing a developer therein. An agitating member is disposed in the developer storing body and mounted on a single rotatable shaft in the developer storing body. The agitating member is rotated by a driving force transmitted to the shaft from the outside of the developer storing body, while agitating the developer. A first hole is formed in the region of the developer storing body containing one point where the developer storing body intersects the center line of the shaft. The first hole is so configured as to allow the agitating member to pass therethrough along the center line of the shaft. A first cap member is removably fitted in the first hole for restricting the movement of the agitating member along the center line of the shaft when fitted, or allowing the agitating member to move along the center of the shaft when removed.

In addition, in accordance with the present invention, a CTM removably mounted to an electrophotographic apparatus includes a toner magazine storing a developer therein and for feeding the developer to a developing device included in the electrophotographic apparatus for developing a latent image electrostatically formed on a photoconductive element. A waste toner tank is constructed integrally with the toner magazine for collecting the developer removed from the photoconductive element. The toner magazine includes a developer storing body storing a developer therein. An agitating member is disposed in the developer storing body and mounted on a single rotatable shaft in the developer storing body. The agitating member is rotated by a driving force transmitted to the shaft from the outside of the developer storing body, while agitating the developer. A first hole is formed in the region of the developer storing body containing one point where the developer storing body intersects the center line of the shaft. The first hole is so configured as to allow the agitating member to pass therethrough along the center line of the shaft. A second hole is formed in the region of the developer storing body containing the other point where the developer storing body intersects the center line of the shaft. A hollow cylindrical cap mounting portion is formed at the end of the developer storing member around the first hole and formed with a male screw on the outer circumference thereof. A first cap member in the form of a cap nut is formed with a female screw engageable with the male screw in the inner circumference thereof. The first cap member seals the first hole when mounted to the cap mounting portion or uncovers the first hole when removed from the cap mounting portion. A second cap is mounted on the end of the shaft remote from the first hole for sealing the second hole when inserted into the second hole from the inside of the developer storing body.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiment of the CTM in accordance with the present invention will be described hereinafter.

1st Embodiment

Figure 1:
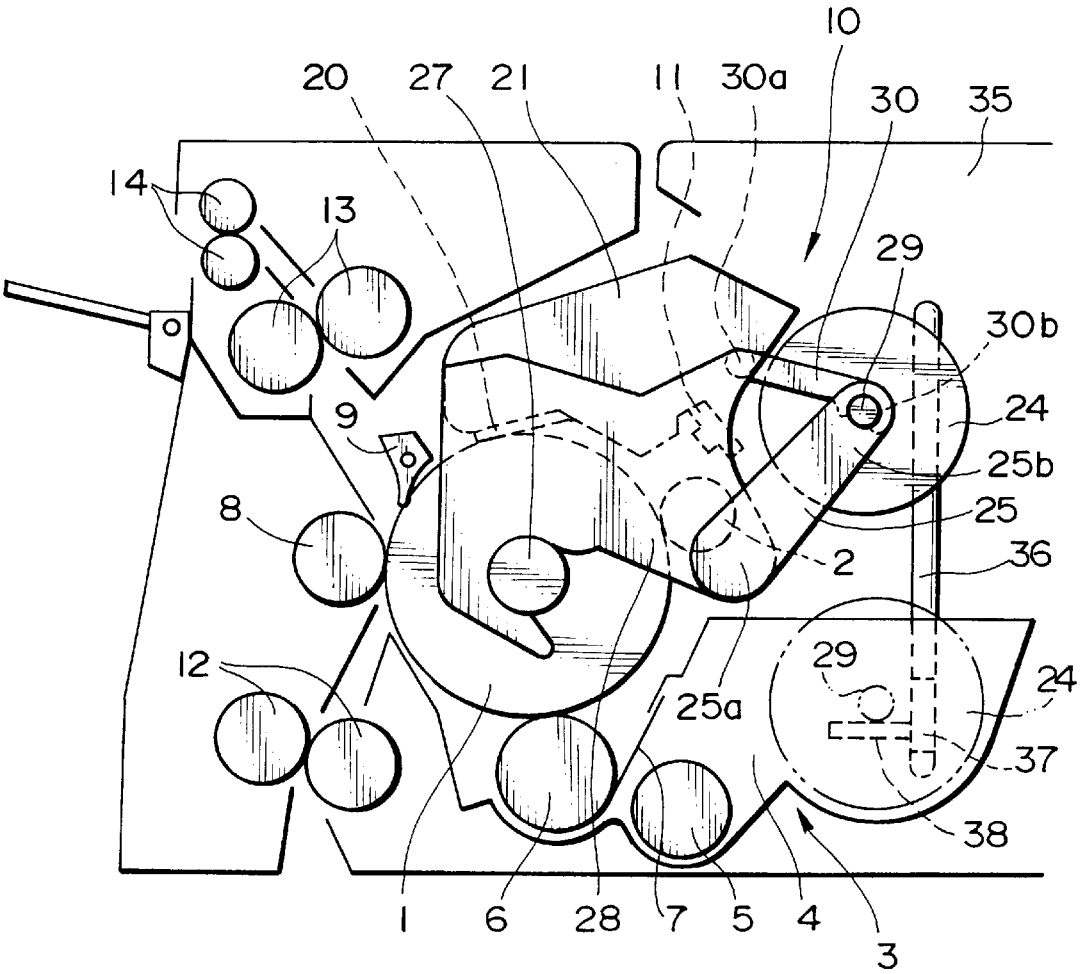
FIG. 1 is a section of an electrophotographic apparatus implemented with a first embodiment of the CTM in accordance with the present invention.

Referring to FIG. 1 of the drawings, an electrophotographic apparatus implemented with a CTM embodying the present invention is shown. As shown, the apparatus has an image carrier in the form of a photoconductive drum 1, a charge roller, or contact charger, 2, and a developing device 3 including a toner reservoir 4, a toner supply roller 5, a developing roller 6, and a blade 7. There are also shown in FIG. 1 an image transfer roller 8, a paper separator 9, a CTM 10 embodying the present invention, a discharge lamp 11, a registration roller pair 12, a fixing roller pair 13, and an outlet roller pair 14.

Figure 2:
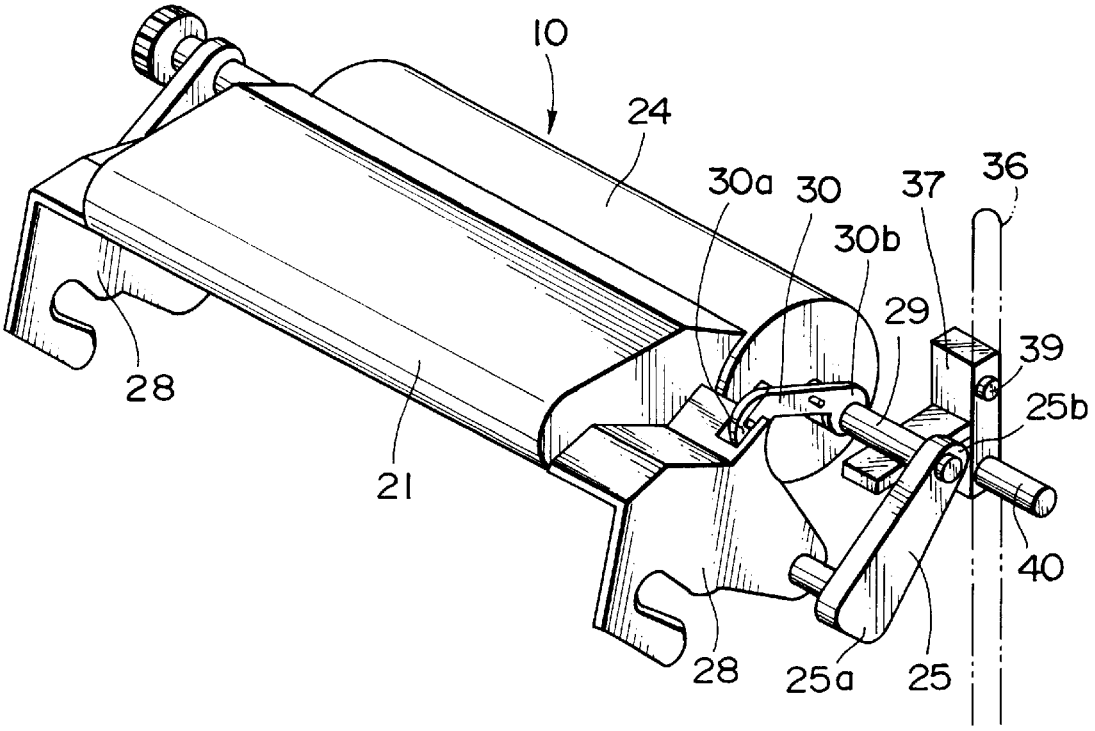
FIG. 2 is a perspective view of the CTM shown in FIG. 1.
Figure 3:
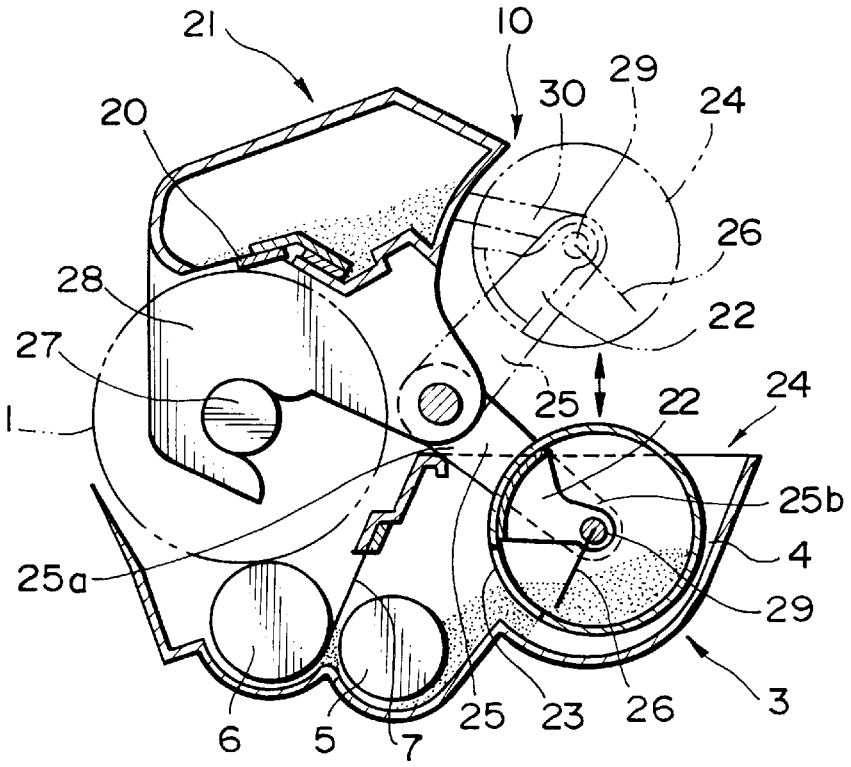
FIG. 3 is a section of the CTM shown in FIG. 1.

As shown in FIGS. 2 and 3, the CTM 10 has a waste toner tank 21 provided with a cleaning blade 20 which removes a toner remaining on the drum 1 in contact with the drum 1. A fresh toner tank 24 stores fresh toner and has an opening 23 which is selectively opened or closed by a shutter 22. An agitator 26 is disposed in the fresh toner tank 24. The waste toner tank 21 and fresh toner tank 24 are movably connected to each other by a lever 25. Specifically, a leg 28 extends out from the side wall of the waste toner tank 21 and is engaged with a rotary shaft 27 on which the drum 1 is mounted. One end 25*a* of the lever 25 is rotatably mounted on the leg 28 while the other end 25*b* is mounted on a shaft 29 which supports the fresh toner tank 24. As shown in FIG. 2, a lock arm, or retaining member, 30 is rotatably connected to the leg 28 at one end 30*a* and movable into and out of engagement with the shaft 29 at the other end 30*b*.

The electrophotographic apparatus has a body or casing 35. As shown in FIG. 2, an elongate slot 36 is formed in the casing 35 in the vertical direction. A liftable member, or returning member, 37 is movable up and down by being guided by the slot 36. The liftable member 37 has an arm 38 extending to a position where it can contact the lower portion of the shaft 29, a guide lug 39 movably received in the slot 36, and a grip 40 extending out to the outside of the casing 35.

The operation of the CTM 10 will be described hereinafter. The image forming procedure implemented by the drum 1, charge roller 2, developing device 3, transfer roller 8 and discharge lamp 11 is conventional and will not be described specifically. In the position indicated by solid lines in FIGS. 1 and 2 and a dash-and-dots line in FIG. 3, the CTM 10 has the waste toner tank 21 and fresh toner tank 24 held in an unmovable condition. The end 30*b* of the lock arm 30 is held in engagement with the shaft 29 of the fresh toner tank 24. In this condition, the CTM 10 can be removed and replaced easily. The CTM 10 may even be put on the market alone in such an unmovable condition. The CTM 10 is set in a predetermined position within the casing 35 with the leg 28 thereof engaged with the shaft 27 of the drum 1. When the lock arm 30 is rotated, it is released from the shaft 29 of the fresh toner tank 24. As a result, the tank 24 is rotated clockwise, as viewed in FIG. 3, about the end 25*a* of the lever 25 and brought into the toner reservoir 4 of the developing device 3. Subsequently, the shutter 22 is moved by drive means, not shown, to uncover the opening 23 of the tank 24. Then, the agitator 26 disposed in the tank 24 is rotated to force the fresh toner into the toner reservoir 4.

In the waste toner tank 21, the cleaning blade 20 scrapes off the toner left on the drum 1 after image transfer, as conventional. The toner removed from the drum 1 is collected in the tank 21.

Assume that the fresh toner tank 24 has run out of toner, requiring the user to replace the CTM 10 with a new CTM. Then, the grip 40 protruding from the liftable body 37 to the outside of the casing 35 is lifted along the slot 36 by hand. Consequently, the arm 38 of the body 37 is brought into contact with the lower portion of the shaft 29 of the fresh toner tank 24, causing the tank 24 to return to the position where it adjoins the waste toner tank 21. As a result, the lock arm 30 is again engaged with the shaft 29 to prevent the two tanks 21 and 24 from moving. In this condition, the CTM 10 can be bodily removed and replaced with ease.

As stated above, the fresh toner tank 24 replenishes the fresh toner while being received in the toner reservoir 4 of the developing device 3. The tank 24 therefore plays the role of a conventional toner hopper at the same time. This eliminates the need for a motor, screw and guide otherwise incorporated to convey the toner, and therefore simplifies construction, reduces size, and saves space. In addition, the CTM 10 is easy to replace because the waste toner tank 21 and fresh toner tank 24 are joined with each other before the replacement.

2nd Embodiment

Figure 4:
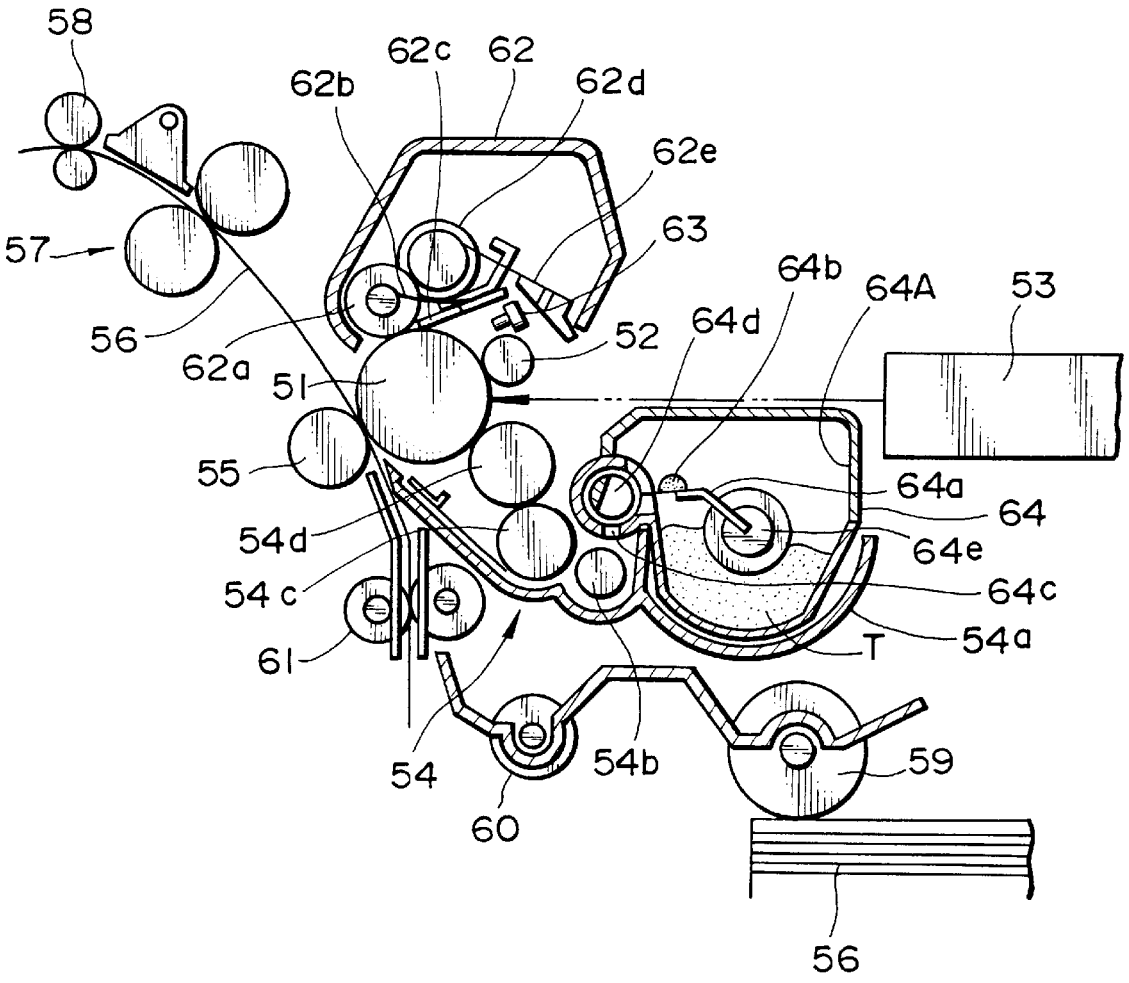
FIG. 4 is a section showing an electrophotographic apparatus incorporating a second embodiment of the present invention.

FIG. 4 shows an electrophotographic apparatus incorporating a second embodiment of the present invention. As shown, the apparatus has a photoconductive drum 51 made up of a metallic core and a photoconductive layer formed on the core. A charge roller, or contact charger, 52 uniformly charges the surface of the drum 51 during image forming operation. Optics 53 exposes the surface of the drum 51 imagewise to form a latent image thereon electrostatically. A fresh toner tank 64 and a waste toner tank 62 constitute a CTM as will be described. A developing device 54 develops the toner image formed on the drum 1 by depositing toner thereon. A transfer roller 55 transfers the resulting toner image from the drum 1 to a paper 56. A fixing roller 57 fixes the toner image on the paper 56 by pressure and heat. An outlet roller 58 drives the paper 56 carrying the toner image thereon out of the apparatus. A pick-up roller 59 picks up the paper 56 and feeds it toward a registration roller 61 via a conveyor roller 60. The registration roller 61 drives the paper 56 toward the transfer roller 55 at a predetermined timing. The developing unit 54 has a hopper 54*a* on which the fresh toner tank 64 is mounted, a toner supply roller 54*b*, a developing roller 54*c* on which the fresh toner from the supply roller 54*b* is deposited in a layer, and a transfer roller 54*d* held in contact with the roller 54*c*. The toner is transferred from the roller 54*c* to the roller 54*d* and then to the drum 51.

As shown in FIG. 4, the waste toner tank 62, forming a part of the CTM, has thereinside a brush roller 62*a* for collecting the toner remaining on the drum 51 after image transfer, a flicker 62*b* held in contact with the brush roller 62*a*, a cleaning blade 62*c* held in contact with the drum 51 for scraping off the toner from the drum 51, a magnet roller 62*d* rotatable while attracting the toner removed from the drum 51, a scraper 62*e* held in contact with the magnet roller 62*d*. The reference numeral 63 designates a discharge lamp for dissipating charges left on the surface of the drum 51 after image transfer, thereby restoring it to the initial condition.

Figure 5:
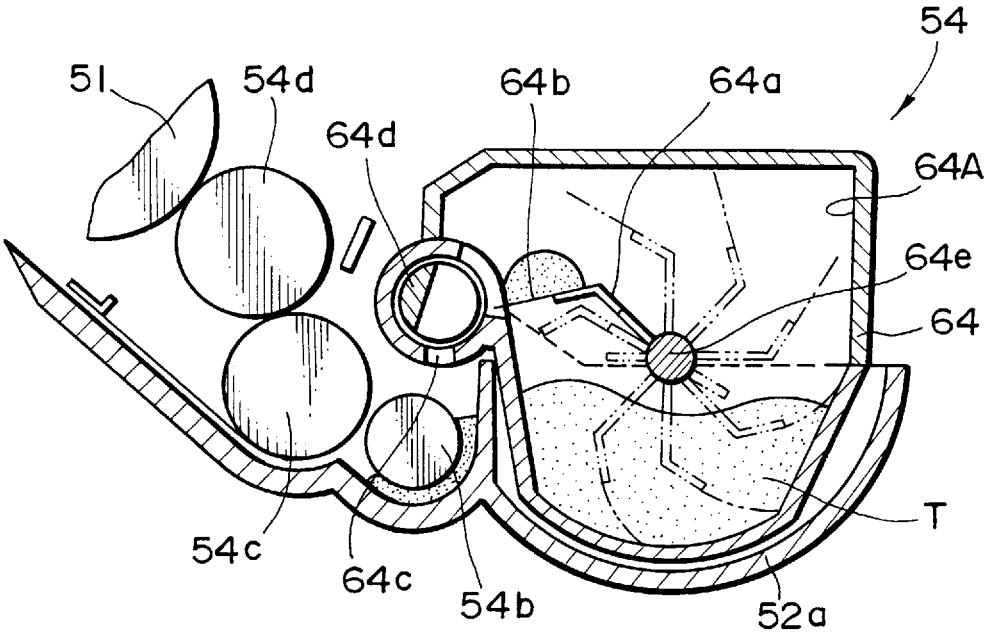
FIG. 5 is a section of a developing device included in the apparatus of FIG. 4.

As shown in FIG. 5, the fresh toner tank 64 stores toner T and accommodates an agitator 64*a*. The agitator 64*a* is rotatable about a shaft 64*e* to agitate the toner T and provided with an elastic member 64*b* on the free end thereof. The agitator 64*a* and elastic member 64*b* constitute a conveying mechanism in combination. The elastic member 64*a* is rotatable to scrape off the toner deposited on the inner periphery 64A of the tank 64. At the same time, this member 64*a* scoops up the fresh toner T and feeds it into an outlet opening 64*c* formed in a part of the tank 64. A shutter 64*d* selectively opens or closes the outlet opening 64*c* in interlocked relation to the tank 64 which is removable from the apparatus.

Figure 6:
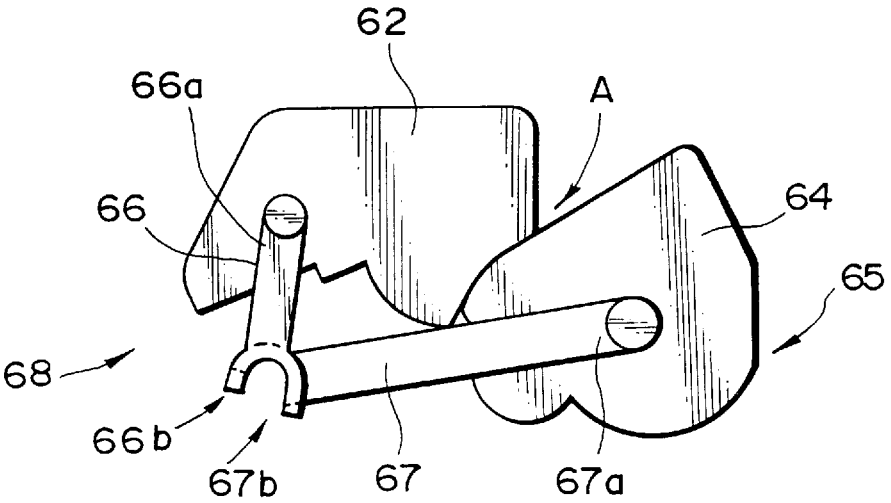
FIG. 6 is a fragmentary section of the second embodiment

As shown in FIG. 6, the waste toner tank 62 and fresh toner tank 64 are linked to each other by a connecting mechanism 68 to constitute a single unit, i.e., CTM 65. As shown, the connecting mechanism 68 has a first arm 66 and a second arm 67. The first arm 66 is mounted on the waste toner tank 62 at one end 66*a* and bifurcated at the other end 66*b*. The second arm 67 is mounted on the fresh toner tank 64 at one end 67*a* and bifurcated at the other end 67*b*. The two tanks 62 and 64 are joined together by a seal member or similar connecting member, not shown, in the event of packing, such that their contact portions A meet each other.

Figure 7:
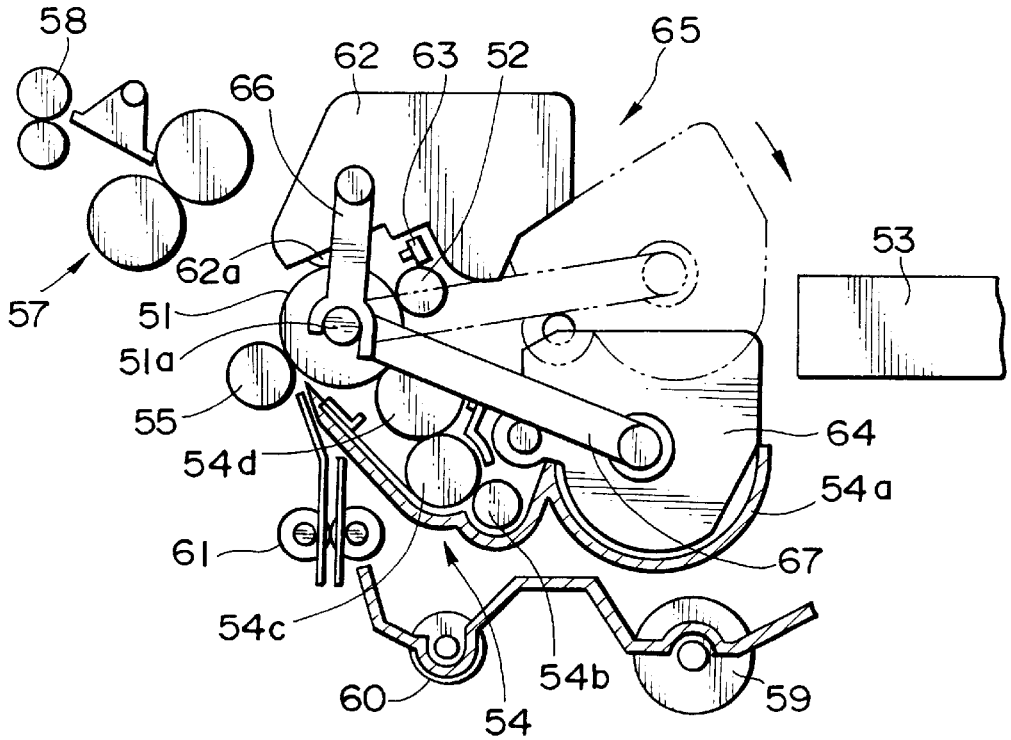
FIG. 7 is a section demonstrating the operation of a third embodiment of the present invention.

As shown in FIG. 7, the CTM 65 is mounted to the apparatus body such that the brush roller 62*a* and cleaning blade 62*c*, FIG. 4, contact the drum 51 at a position preceding the position where the discharge lamp 63 illuminates the drum 51. At this instant, the bifurcated ends 66*b* and 67*b* of the arms 66 and 67, respectively, are engaged with the shaft 51*a* on which the drum 51 is mounted. After the connecting member has been removed from the CTM 65, the CTM 65 is inserted into the apparatus body. As the fresh toner tank 64 is mounted to the hopper 54*a*, the shutter 64*d* is opened while, at the same time, the shaft 64*e* of the agitator 64*a* is connected to a drive gear or similar drive source, not shown. During image formation, the agitator 64*a* is rotated to scoop up the fresh toner T with the free end and elastic member 64*b* thereof. This part of toner is brought to the outlet opening 64*c*. The toner T from the opening 64*c* is deposited on the supply roller 54*b* and conveyed by the roller 54*b* to the developing roller 54*c*. Subsequently, the toner T is transferred from the roller 54*c* to the transfer roller 54*d* and then to the drum 51, thereby developing a latent image formed on the drum 51. The resulting toner image is transferred from the drum 51 to a paper.

In a modification of the illustrative embodiment, the two tanks 62 and 64 are not connected by the connecting mechanism 68, but are inserted into the apparatus body in a separated state, as shown in FIG. 4.

As stated above, in the embodiment and modification thereof, the waste toner tank 62 and fresh toner tank 64 of the CTM 65 are separable from each other. Further, because the tank 64 is mounted to the hopper 54*a* by being rotated, it occupies a minimum of space. Consequently, the tank 64 can be provided with a great volume, and the overall size of the apparatus can be reduced.

3rd Embodiment

Figure 8:
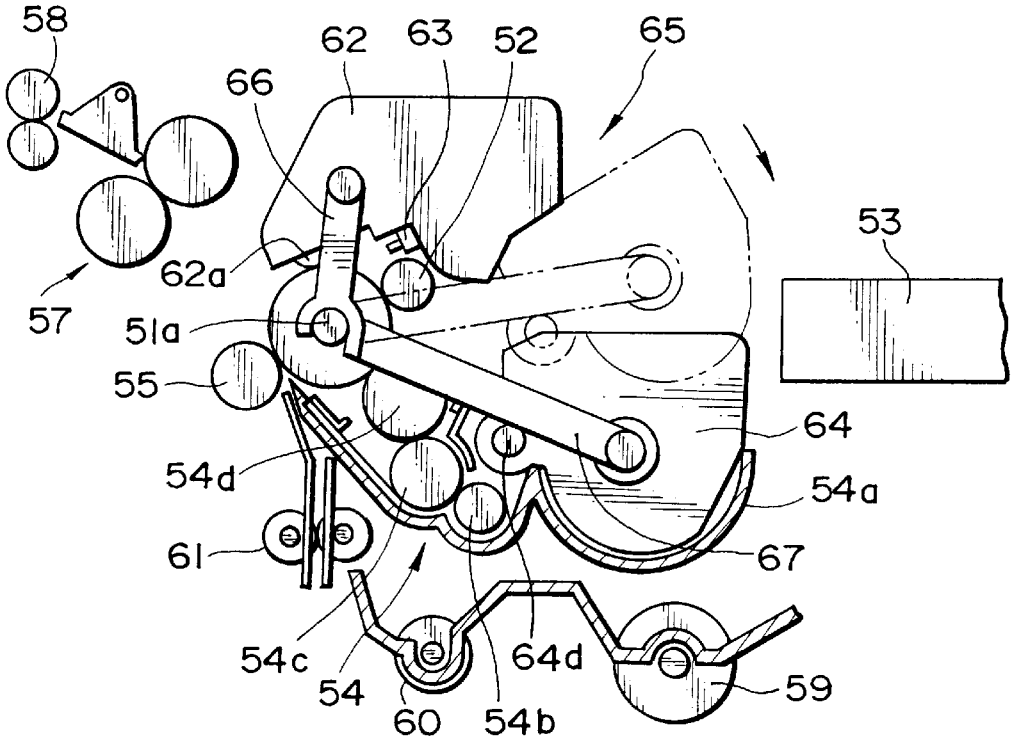
FIG. 8 is a section of an electrophotographic apparatus implemented with the third embodiment.

A third embodiment of the present invention is shown in FIG. 8. As shown, the CTM 65 is similar to the CTM 65 of FIG. 7 except that the discharge lamp 63 is mounted on the waste toner tank 62. Hence, the discharge lamp 63 is removable from the apparatus body together with the CTM 65.

4th Embodiment

Figure 9:
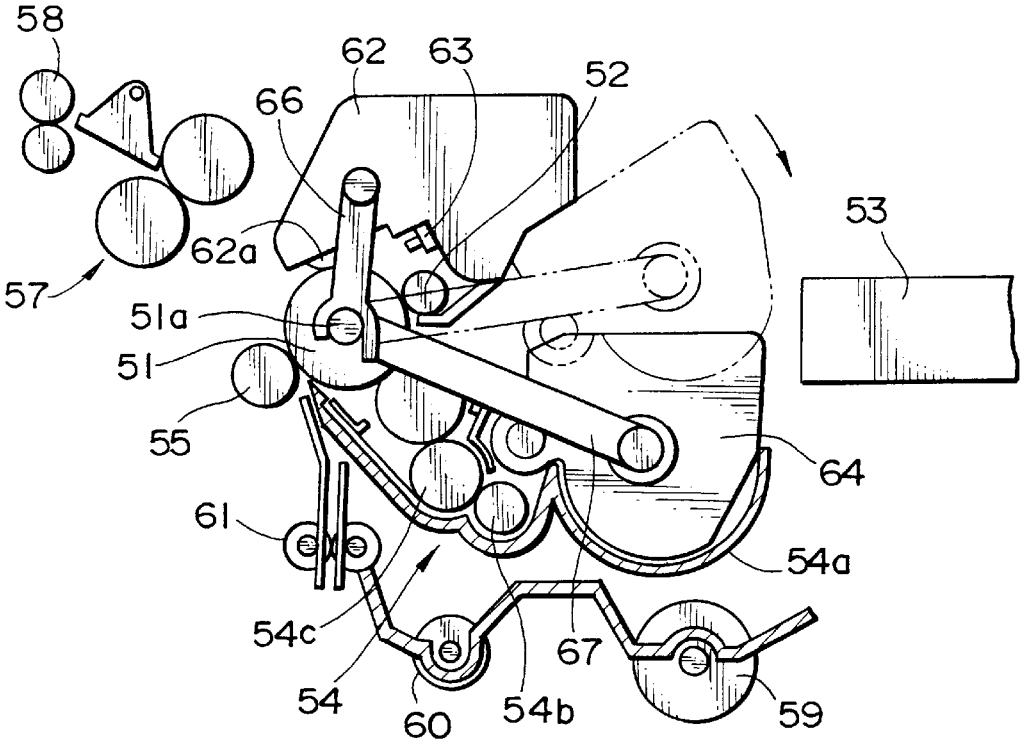
FIG. 9 is a section of an electrophotographic apparatus incorporating a fourth embodiment of the present invention.

FIG. 9 shows a fourth embodiment of the present invention. As shown, the CTM 65 is similar to the CTM 65 of FIG. 8 except that the charge roller 52 is mounted on the waste toner tank 62. This allows the discharge lamp 65 and charge roller 52 to be removed from the apparatus body together with the waste toner tank 62.

5th Embodiment

Figure 10:
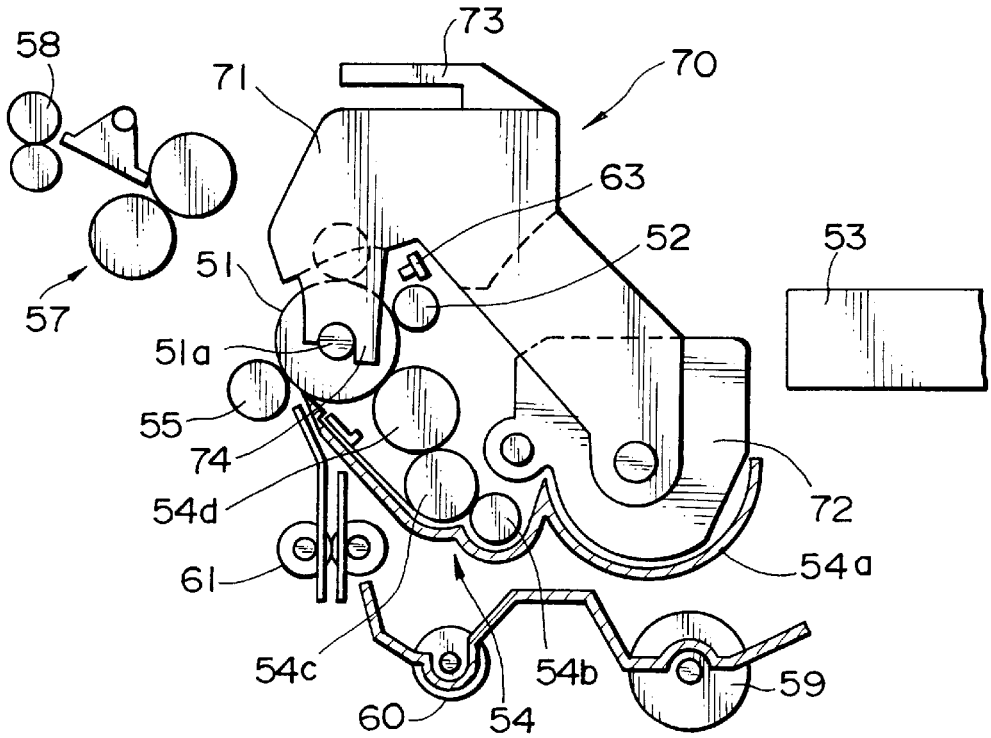
FIG. 10 is a section of an electrophotographic apparatus implemented with a fifth embodiment of the present invention.

Referring to FIG. 10, a fifth embodiment of the present invention will be described. Since this embodiment is essentially similar to the second embodiment of FIGS. 4 and 5, the same constituent parts as the parts of the second embodiment are designated by the same reference numerals. As shown, the CTM, generally 70, is made up of a waste toner tank 71 and a fresh toner tank 72. The waste toner tank 71 is provided with a grip 73 and a bifurcated engaging portion 71 which is engageable with the shaft 5 la of the drum 51. To mount the CTM 70 to the apparatus body, the operator holds the grip 73, brings engaging portions 74 into engagement with the shaft 51*a*, and positions the fresh toner tank 72 on the hopper 54*a* of the developing unit 54. At the same time as the CTM 70 is mounted to the apparatus body, various constituents disposed in the waste toner tank 71 each is brought to a particular position relative to the drum 51. In the case where the discharge lamp 63 and/or the charge roller 52 are mounted on the CTM 70 as in the previous embodiments, they will also be located in predetermined positions relative to the drum 51.

Figure 11:
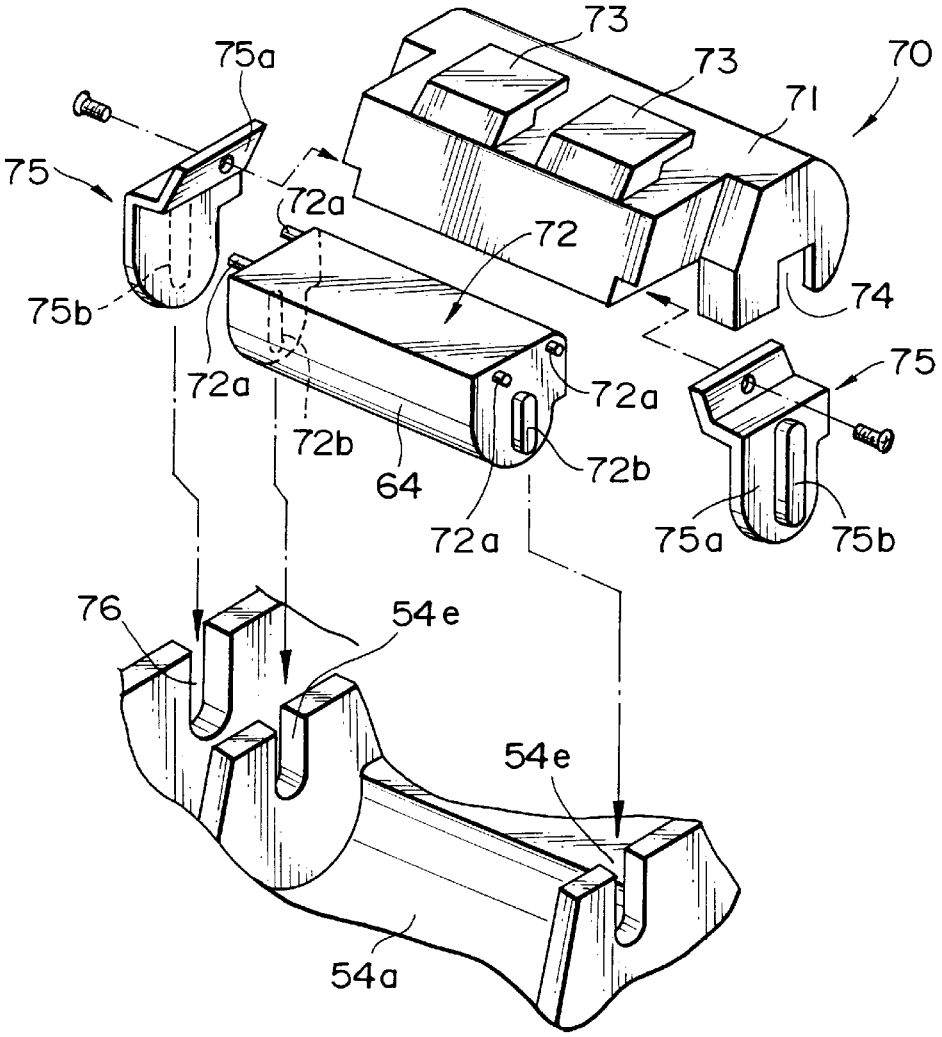
FIG. 11 is an exploded perspective view of the embodiment shown in FIG. 10.
Figure 12:
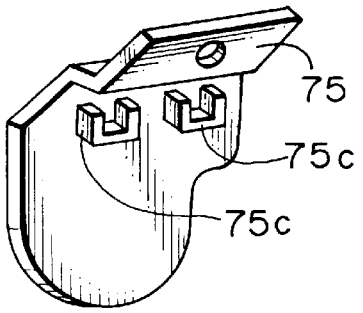
FIG. 12 is a perspective view of a connecting member shown in FIG. 11.
Figure 13:
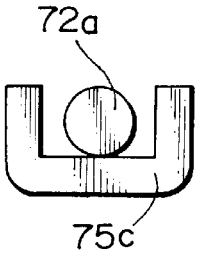
FIG. 13 is a plan view showing a seat and a boss included in the connecting member of FIG. 12 and resting on the seat.

As shown in FIG. 11 in an exploded view, the CTM 70 has connecting members 75 connecting the waste toner tank and fresh toner tank 72. Each connecting member 75 is implemented as a stepped plate 75*a*. A relatively long projection or guide 75*b* is formed on the outer surface of each stepped plate 75*a* and extends in the direction for mounting the CTM 70 to the apparatus body. As shown in FIGS. 12 and 13, seats 75*c* for receiving bosses, which will be described, are formed on the inner surface of each plate 75*a*.

As shown in FIG. 11, the fresh toner tank 72 is provided with two bosses 72*a* in an upper portion of each end thereof, and a relatively long projection or guide 72*b* at substantially the center of each end. The connecting members 75 are affixed to the tank 71 with the seats 75*c* thereof each supporting the respective boss 72*a,* thereby completing the CTM 70. As shown in FIG. 13, the fresh toner tank 72 is held integrally with the waste toner tank 71 with some play. The hopper 54*a* is formed with groove-like guide rails 54*e* at opposite sides thereof for guiding the guides 72*b* of the tank 72. A groove-like guide rail 76 is formed in the apparatus body outside of each guide rail 54*e* in order to guide the respective guide 75*b* of the connecting member 75.

To mount the CTM 70 to the apparatus body, the guides 75*b* are slowly inserted into the guide rails 76 while being guided by the latter. At the same time, the guides 72*b* are inserted into the guide rails 54*e*. As soon as the engaging portions 74 are brought into engagement with the shaft 51*a*, the fresh toner tank 72 is positioned in the hopper 54*a*. The tank 72 has some play, as mentioned above, and can be positioned in the hopper 54*a* even if the guide rails 54*e* have some dimensional error.

As stated above, the guides 75*b* and 72*b* provided on the CTM 70 and the corresponding guide rails 76 and 54*e* allow the CTM 70 to be positioned accurately relative to the drum 51 and developing unit 54. In addition, the grip 73 promotes easy handling of the CTM 70.

6th Embodiment

Figure 14:
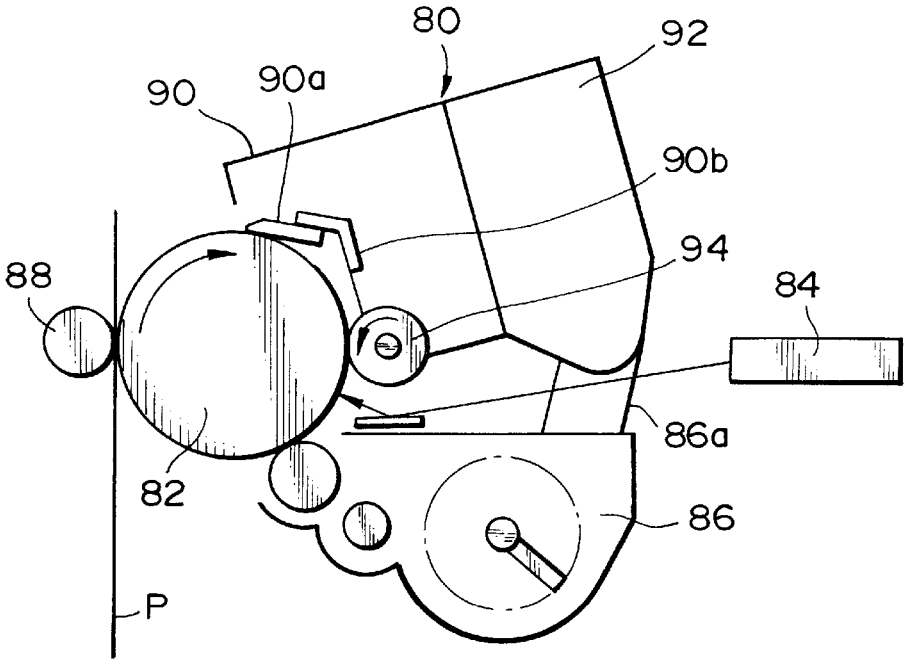
FIG. 14 is a section of an electrophotographic apparatus incorporating a sixth embodiment of the present invention.

FIG. 14 shows an electrophotographic apparatus implemented with a sixth embodiment of the present invention. As shown, the apparatus has a photoconductive drum 82, a laser unit 84 for scanning the drum 82 with a laser beam, a developing device 86, a transfer roller 88, and a CTM 80. The CTM 80 has a waste toner tank 90 and a fresh toner tank 92 constructed integrally with each other. A cleaning blade 90*a* and a blade holder 90*b* are disposed in the waste toner tank 90. When the CTM 80 is mounted to the apparatus body, as shown in the figure, a charge roller 94 contacts the surface of the drum 82. A mechanism, which will be described, causes the charge roller 94 to rotate in association with and at the same linear velocity as the drum 82. When a charge voltage is applied to the roller 94, the roller 94 charges the surface of the drum 82 uniformly to a predetermined polarity. The laser unit 84 scans the charged surface of the drum 82 with a laser beam to form an electrostatic latent image thereon. The developing device 86 develops the latent image with toner to form a corresponding toner image. As a paper P is transported to an image forming region where the transfer roller 88 is located, the roller 88 transfers the toner image from the drum 82 to the paper P while nipping it in cooperation with the drum 82. After the image transfer, the cleaning blade 90*a* removes the toner remaining on the drum 82 and collects it in the waste toner tank 90. The fresh toner tank 92 replenishes the developing device 86 with fresh toner via a duct 86*a* such that the amount of toner in the device 86 remains constant. When the waste toner tank 90 is filled with the collected toner or when the fresh toner tank 92 runs out of toner, a message for urging the user to replace the CTM 80 is displayed. The user therefore can replace the CTM 80 periodically.

Figure 15:
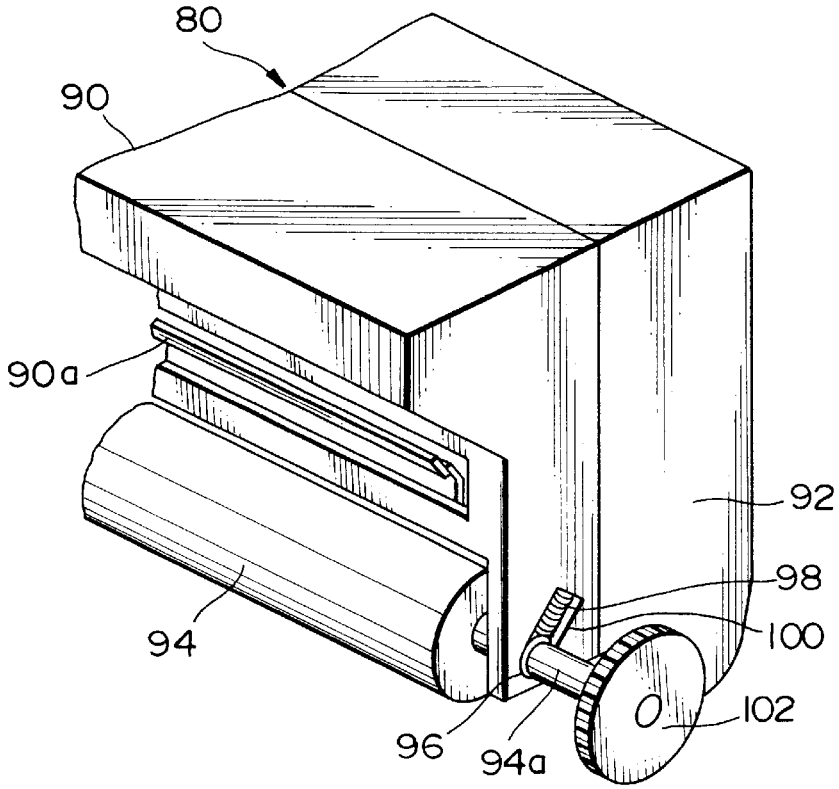
FIG. 15 perspective view of the embodiment shown in FIG. 14.
Figure 16:
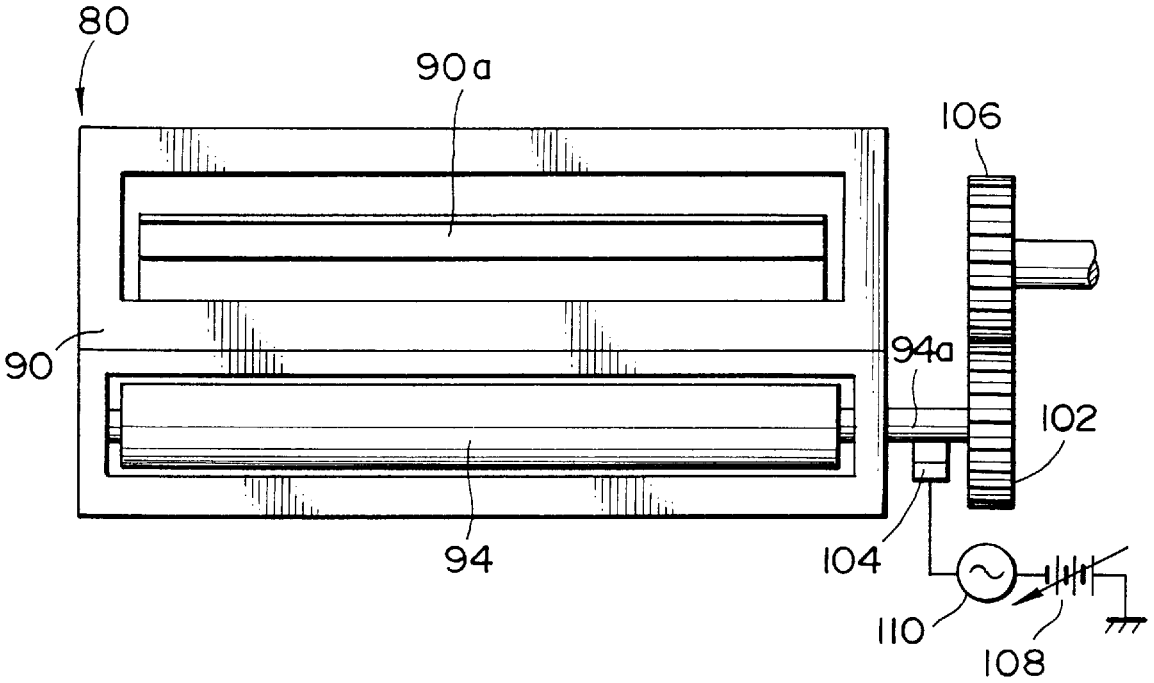
FIG. 16 is a plan view of the embodiment of FIG. 14 mounted to the electrophotographic apparatus.

FIGS. 15 and 16 show the CTM 80 more specifically. As shown, the waste toner tank 90 is formed with an elongate slot 100 in each of opposite ends thereof. The charge roller 94 is mounted on a rotary shaft 94*a* which is made of a conductive material and rotatably supported by bearings 96. The bearings 96 each is received in the respective slot 100 of the tank 90 together with a spring 98 and constantly biased toward one end of the slot 100 by the spring 98. A drive gear 102 is affixed to one end of the shaft 94*a*.

As shown in FIG. 16, when the CTM 80 is mounted to the apparatus, a brush 104 contacts the periphery of the shaft 94*a*. At the same time, the drive gear 102 is brought into mesh with a gear 106 which is connected to a drive motor, not shown. Connected to the brush 104 are a DC power source 108 for generating a DC voltage in association with the drive motor, and a DC/AC converter 110 for converting the DC voltage to an AC charge voltage. In the position shown in the figure, the charge roller 94 is urged against the drum 82 by the springs 98.

During image formation, the charge roller is rotated at the same linear velocity as the drum 82 by the motor via the gears 106 and 102. As a result, the surface of the drum 82 is uniformly charged and prepared for the formation of a latent image using a laser beam.

Figure 17:
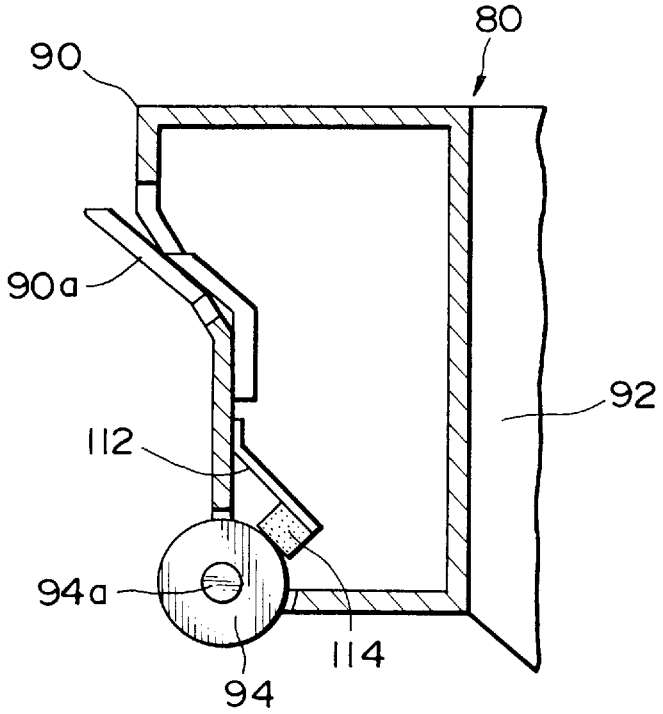
FIG. 17 is a section of a cleaning device included in the embodiment of FIG. 14 and disposed in a waste toner tank.

FIG. 17 shows a device for cleaning the waste toner tank 90 of the illustrative embodiment. As shown, the cleaning device has a stay 112 fixed in place in the tank 90, and a cleaning member 114 fitted on the free end of the stay 112. The cleaning member 114 may be constituted by felt and silicone oil applied thereto. Generally, it is likely that the toner left on the drum 82 after image transfer, paper dust and other impurities are transferred to the charge roller 94, and that the toner scattered around in the apparatus deposits on the charge roller 94. Such deposits on the roller 94, even if a little, prevent the roller 94 from contacting the drum 82 stably. Then, the roller 94 fails to charge the drum 82 uniformly. The cleaning member 114 in rotation slides on the surface of the roller 94 to remove such deposits from the roller 94 and collects them in the tank 90. This successfully preserves the charging ability of the roller 94 over a long period of time and prevents the interior of the apparatus from being contaminated.

In this embodiment, the charge roller 94 is replaced together with the CTM 80, i.e., the roller 94 whose charging ability lowers due to aging is replaced periodically. Hence, the roller 94 is maintained in a desirable state at all times. It follows that the drum 82 can be uniformly charged by a contact charger which produces a minimum of ozone.

7th Embodiment

Figure 18:
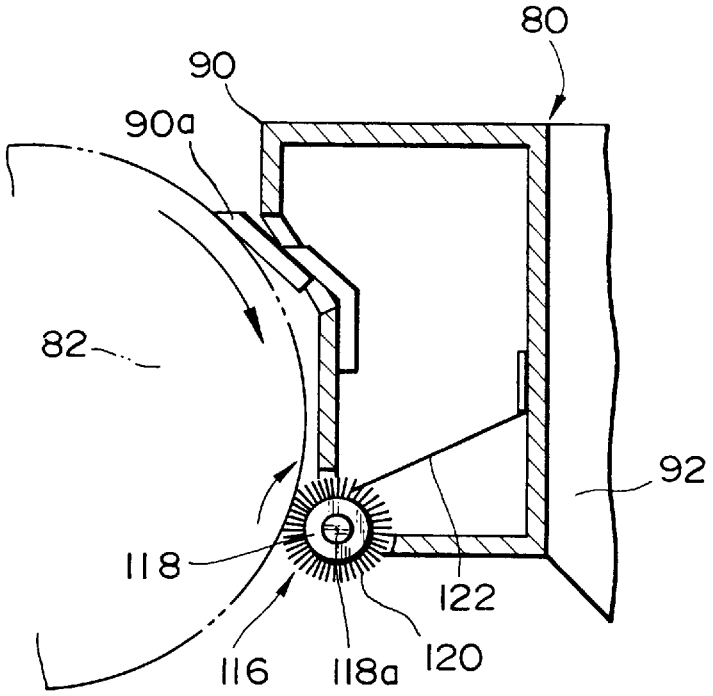
FIG. 18 is a section showing a seventh embodiment of the present invention.

FIG. 18 shows a seventh embodiment of the present invention. As shown, the waste toner tank 90 of the CTM 80 is similar to the tank 90 of the sixth embodiment except that a charge brush 116 is substituted for the charge roller 94. The charge brush 116 has a roller portion 118 and a brush portion 120 implanted in the roller portion 118. Assume that the CTM 80 is mounted to the apparatus body, and an image forming operation is effected. Then, a shaft 118*a*, on which the roller portion 118 is mounted, is driven by a drive motor, not shown, with the result that the roller portion 118 is rotated in the same direction as the drum 82. Further, a charge voltage is applied from the apparatus body to the brush portion 120 via the roller portion 118. In this condition, the outer periphery of the brush portion 120 charges the surface of the drum 82 uniformly while sliding thereon. The tank 90 is provided with a cleaning device, as in the sixth embodiment. The cleaning device is implemented by a thin elastic cleaning sheet 122 which is held in contact with the brush portion 120 at the free end thereof. While the charge brush 116 is in rotation, the cleaning sheet 122 causes the brush portion 120 to elastically deform and vibrate, thereby causing the deposits to fall from the brush portion 120. The deposits so removed from the brush 120 are collected in the tank 90. Again, this successfully preserves the charging ability of the charge brush 116 for a long time and prevents the interior of the apparatus from being contaminated.

In this embodiment, the charge brush 116 is replaced together with the CTM 80, i.e., the brush 116 whose charging ability lowers due to aging is replaced periodically. Hence, the roller brush 116 is maintained in a desirable state at all times. It follows that the drum 82 can be uniformly charged by a contact charger which produces a minimum of ozone.

8th Embodiment

Figure 19:
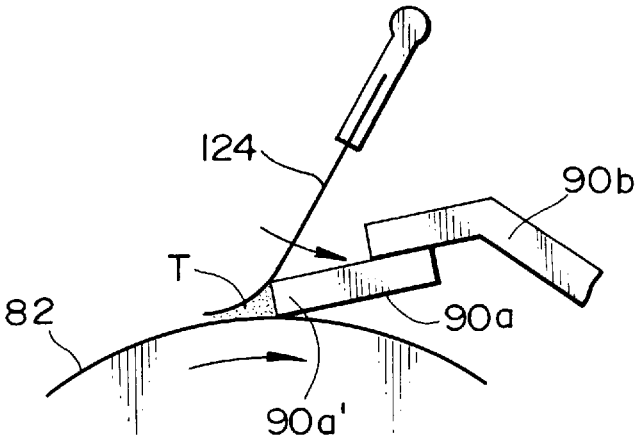
FIG. 19 PRIOR ART
FIG. 19 is a fragmentary section of a conventional CTM.

An eighth embodiment of the present invention to be described is similar to the embodiment FIG. 14, but it allows the cleaning blade 90*a* of the waste toner tank 90 to effect more efficient cleaning. As shown in FIG. 19, there has been proposed an arrangement wherein the cleaning blade 90*a* removes the toner T left on the drum 82 after image transfer with the edge 90'*a* thereof, while a rotatable brush 124 scrapes it off into the tank 90. This kind of arrangement can collect the toner into the tank 90 more efficiently than the traditional arrangement wherein the blade 90*a* simply removes the remaining toner from the drum 82. However, the prerequisite for the brush 124 to scrape the toner into the tank 90 is that it be bent to some degree beforehand. In the initial stage of operation, such a bent form of the brush 124 does not matter at all. However, the problem is that the because the tank 90 is usually located in the vicinity of a fixing section, not shown, the brush 124 is apt to deform due to thermal stresses, among others, resulting in the decrease in toner collecting ability. This embodiment is constructed and arranged to eliminate this problem.

Figure 20:
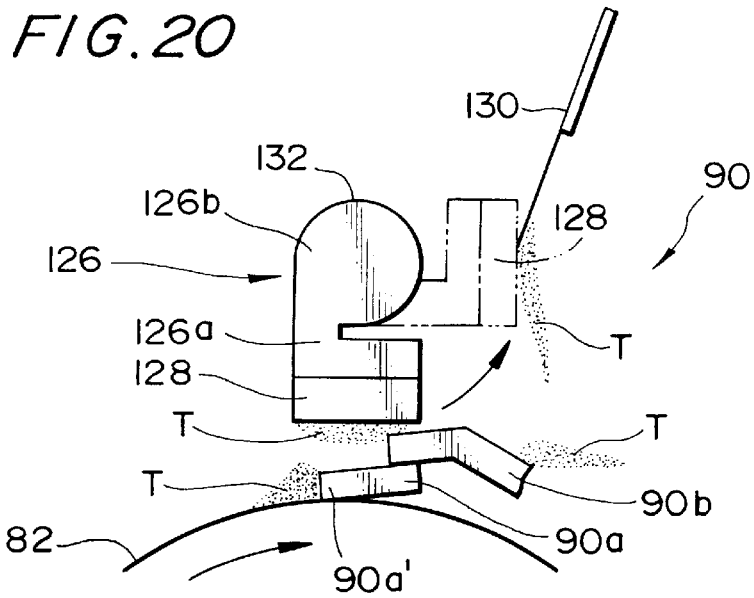
FIG. 20 is a section of a waste toner tank representative of an eighth embodiment of the present invention.

As shown in FIG. 20, the waste toner tank 90 of this embodiment is provided with a holder 126 made up of an arm 126*a* and a rotatable portion 126*b* contiguous with the arm 126*a*. The holder 126 is located in close proximity to the cleaning blade 90*a* which removes the toner T from the drum 82 in contact with the drum 82. A magnet 128 is affixed to the arm 126*a* of the holder 126 by a two-sided adhesive tape or hot melt adhesion by way of example. A scraper 130 is located in the range of rotation of the magnet 128 so as to scrape off the toner T from the magnet 128. The holder 126 and magnet 128 constitute a rotatable magnet body 132. In operation, when the magnet body 132 is rotated counterclockwise, as viewed in FIG. 20, about the rotatable portion 126*b* of the holder 126, the toner T removed by the cleaning blade 90*a* from the drum 82 is magnetically attracted by and deposited on the magnet 128. As the holder 126 is further rotated, the scraper 130 scrapes off the toner T from the magnet 128 into the tank 90.

Figure 21A:
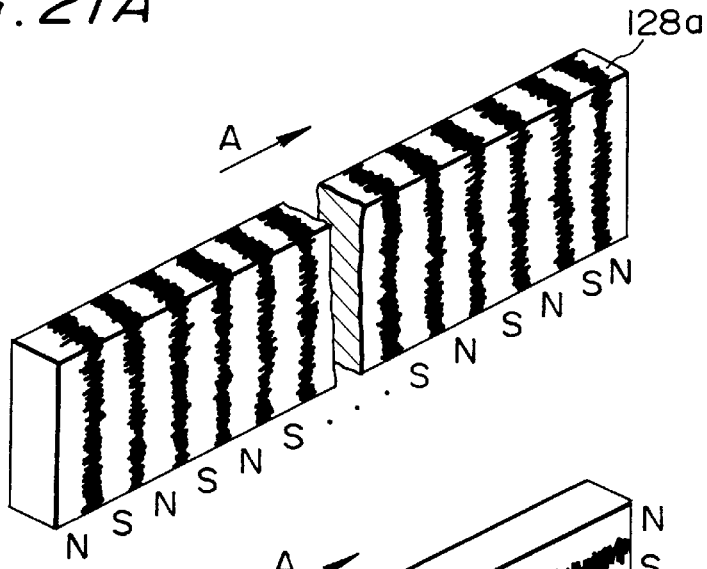
FIGS. 21A and 21B are perspective views each showing a rotary magnet body included in the eighth embodiment in a particular condition of magnetization.
Figure 21B:
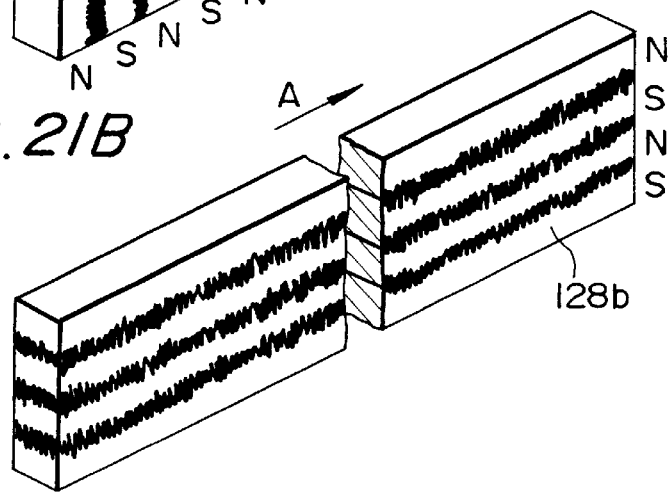

FIG. 21A and 21B each shows a particular manner of deposition of the toner T on the magnet 128 which depends on the direction of magnetization. Specifically, FIG. 21A shows a magnet 128*a* magnetized in the direction perpendicular to the main scanning direction (arrow A) of the drum 82, while FIG. 21B shows a magnet 128*b* magnetized in the direction parallel to the direction A. The toner T is deposited on the polar portions of the magnets 128*a* and 128*b*, depending on the polarity. Hence, the magnet 128*b* of FIG. 21B can attract the toner T uniformly in the main scanning direction A. The magnet 128*a* of FIG. 21A cannot attract the toner T in the direction A in the same manner as the magnet 128*b* unless it is capable of exerting a great magnetic force.

Figure 22:
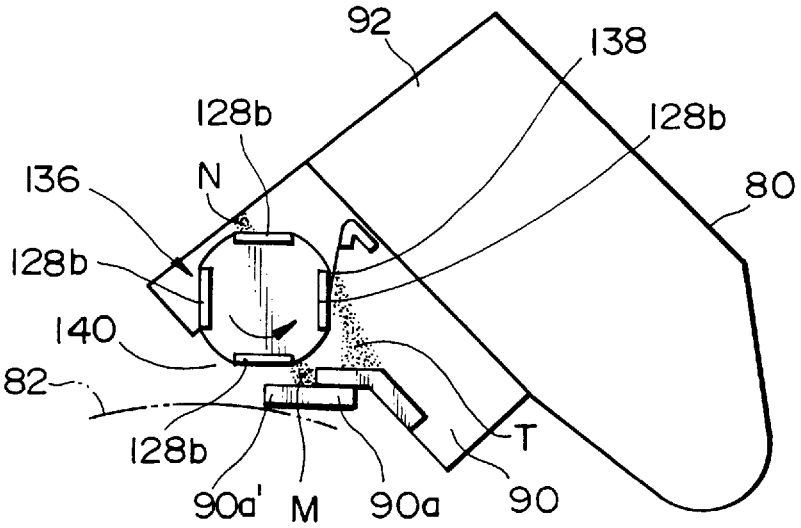
FIG. 22 is a section of a modification of the eighth embodiment.
Figure 23:
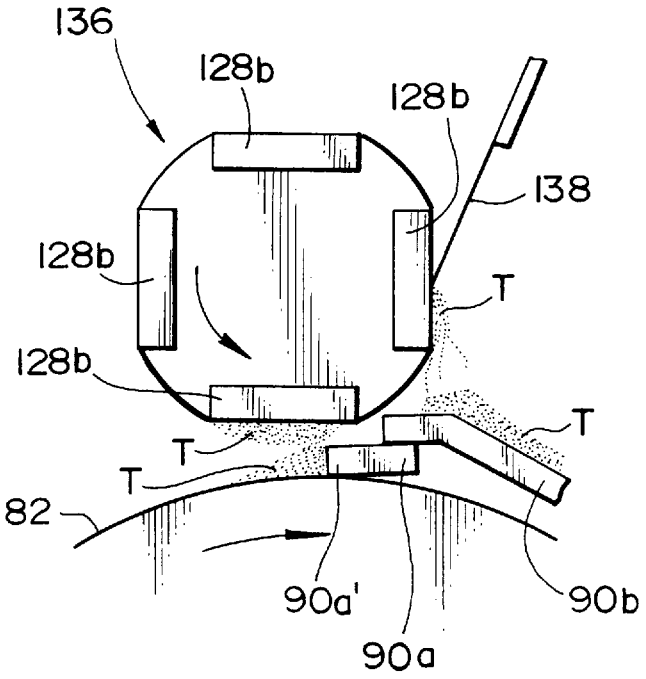
FIG. 23 is a section showing another modification of the eighth embodiment.

FIGS. 22 and 23 show a modification of the eighth embodiment. As shown, the waste toner tank 90 is also provided with the cleaning blade 90 held in contact with the drum 82 at the edge 90'*a* thereof for removing the toner T, and the holder 90*b*. A cylindrical rotatable magnet body 136 is located in close proximity to the blade 90*a* and provided with a plurality of (four in the modification) magnets 128*b* each being magnetized as shown in FIG. 21B. The scraper 138 is located in the range of rotation of the magnet body 136, as in the eighth embodiment. It will be seen that the modification has a greater number of magnets, and can therefore attract a greater amount of toner than the eighth embodiment for a single rotation of the magnet body.

In the eighth embodiment and modification thereof, assume that the amount of toner left on the drum 82 for a unit time is $w_a$ (g/sec), that the rotation speed of the magnet body 132 or 136 is n (r.p.m), and that the the amount of toner to deposit on the magnet body 132 or 136 is $w_b$ (g). Then, because the ability to remove the remaining toner should exceed the amount of remaining toner to occur, the following relation must be satisfied:

$$\frac{n}{60} \cdot w_b > w_a$$

Therefore, $$n > 60 \cdot \frac{w_a}{w_b}$$

The amount $w_a$ of remaining toner increases with the increase in the linear velocity of the drum 82. In light of this, the lower limit of the rotation speed n of the magnet body 132 or 136 may be increased. Specifically, a motor for driving the magnet body 132 or 136 may be rotated at a higher speed, or the gear ratio of the gearing may be changed. This kind of approach, however, would increase the cost or would require a different layout. In the illustrative embodiment, the number of magnets on the magnet body 132 or 136 may be increased to increase the amount of toner deposition by twice, three times or even more, thereby lowering the lower limit of the rotation speed n. Further, when the linear velocity of the drum 82 is low, the number of magnets may be reduced. The crux is that the number of magnets of the magnet body 132 or 136 be changed in matching relation to the linear velocity of the drum 82.

Moreover, as shown in FIG. 22, the magnet body 136 blocks an opening 140 formed through the tank 90. When the body 136 is brought to a stop, the magnets 128*b* are located in the vicinity of the paths N and M along which the toner T flows to the outside. In this configuration, the toner T forming columns on the magnets 128*b* obstructs the paths N and M so as to prevent the toner T collected in the tank 90 from flowing out.

9th Embodiment

Figure 24:
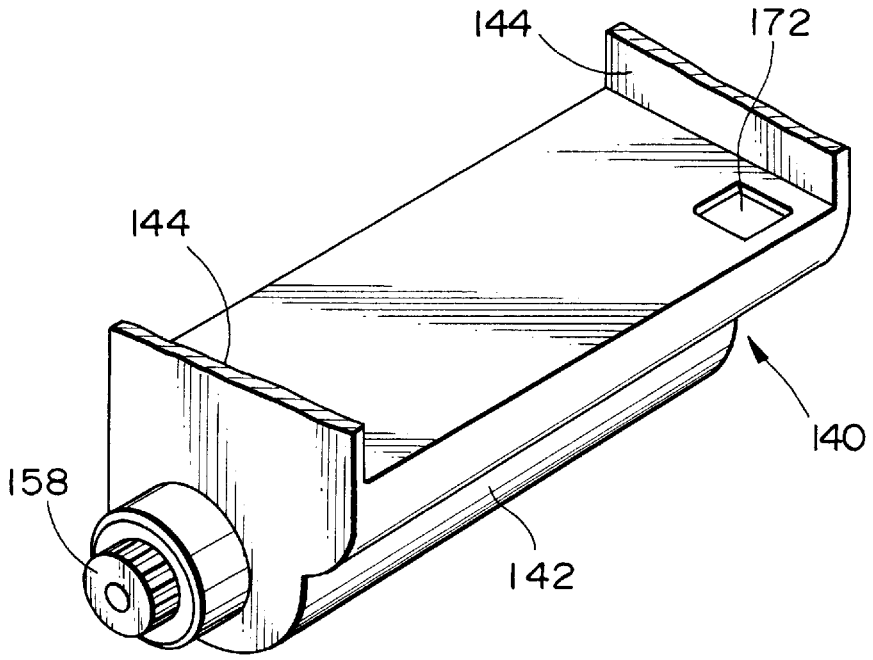
FIG. 24 is a perspective view showing a toner magazine representative of a ninth embodiment of the present invention.
Figure 25:
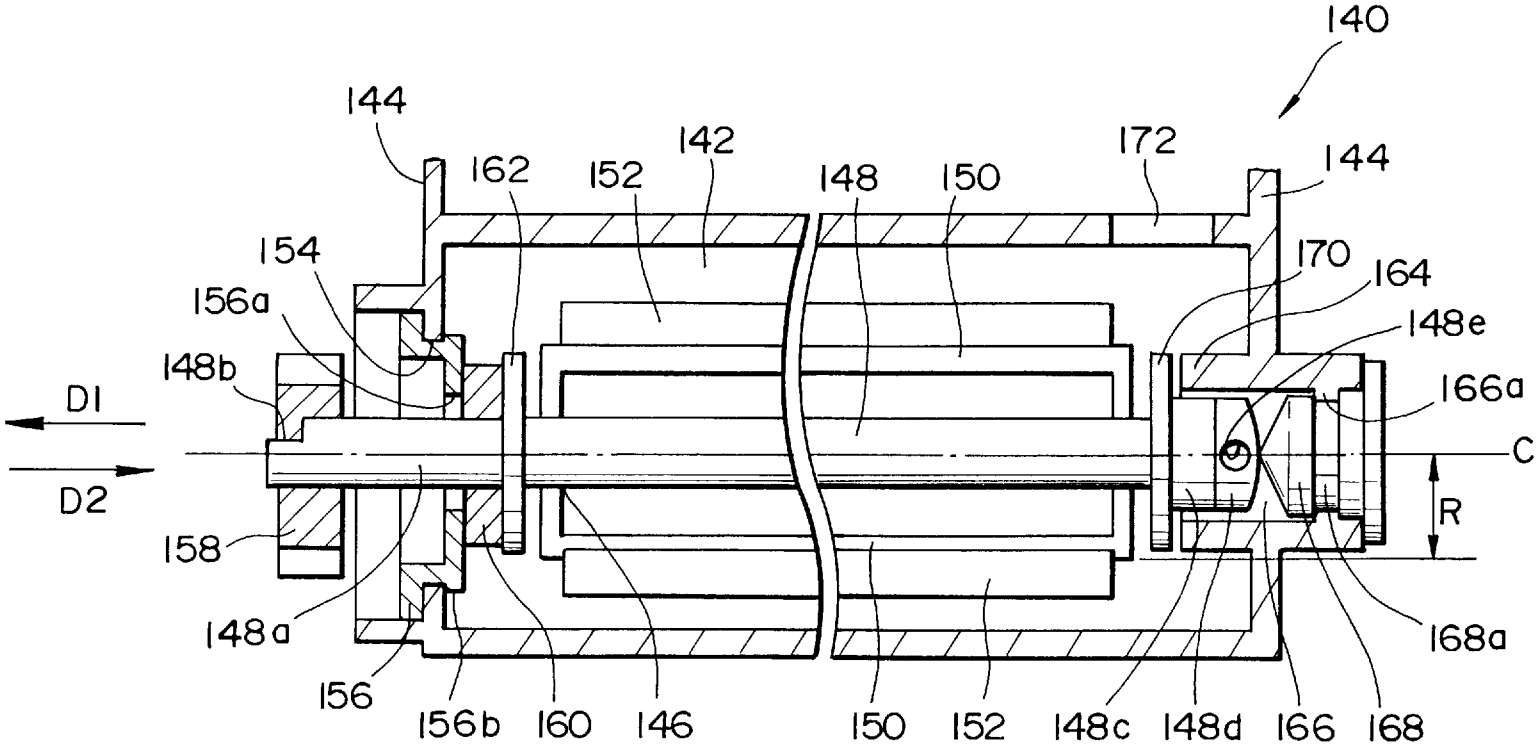
FIG. 25 is a section of the toner magazine shown in FIG. 24.

Referring to FIGS. 24 and 25, a toner magazine 140 representative of a ninth embodiment of the present invention will be described. As shown, the toner magazine 140 includes a fresh toner tank 142 storing fresh toner therein. The magazine 140 is connected to a waste toner tank, not shown, by a pair of plates 144 and constitutes a CTM together with the waste toner tank. An agitator 146 is disposed in the toner tank 142 and made up of a single rotary shaft 148, an agitating portion 150 protruding radially outward from the shaft 148, and an elastic sheet 152 fitted on the radially outermost edge of the agitating portion 150.

A hole 154 is formed in one end wall of the toner tank 142. A cap member 156 is removably received in the hole 154 and formed with a bearing hole 156*a* in which one end of the shaft 148 is received. The end of the shaft 148 rotatably supported by the cap member 156 protrudes from the toner tank 142 to the outside. The cap member 156 is formed of resin or similar elastic material and includes a larger diameter portion 156*b* whose outside diameter is slightly larger than the inside diameter of the hole 154. When the cap member 156 is inserted in the hole 154, the larger diameter portion 156*b* is located in the toner tank 142 and prevents the cap member 156 from slipping out due to its elasticity.

The end of the shaft 148 protruding from the toner tank 142 is formed with a key 148*b*. A driven gear 158 is mounted on this end of the shaft 148 and operatively connected to a drive mechanism, not shown. The shaft 148 includes a flange 162 positioned in the toner tank 142. An elastic seal ring 160 is held between the flange 162 and the cap member 156 in a compressed condition. The seal ring 160 prevents toner in the toner tank 142 from leaking through the hole 156*a*.

The toner tank 142 has a hollow cylindrical bearing portion 164 on its end opposite to the end formed with the hole 154. The other end 148*c* of the shaft 148 is received in and rotatably supported by the bearing portion 164. A flat catch portion 148*d* extends axially outward from the end 148*c* of the shaft 148 and is formed with a hole 148*e* for receiving a jig, not shown. A hole 166 is formed in the end of the bearing portion 164 and located on the imaginary extension of the shaft 148. Another cap member 168 is removably fitted in the hole 166. An annular groove 166 is formed in the outer circumference of the cap member 168 while an annular lug 166*a* is formed on the wall of the hole 166. When the cap member 168 is inserted into the hole 166, the groove 168*a* mates with the lug 166*a* so as to prevent the cap member 168 from slipping out due to its elasticity. The shaft 148 additionally includes an annular flange 170 adjoining the bearing portion 164. The flanges 162 and 170 determine the position of the agitator 146 in the axial direction.

As shown in FIG. 24, a window 172 is formed in the top of the toner tank 142, so the operator can see the bearing portion 164 and its neighborhood disposed in the toner tank 142. A transparent member, e.g., glass is fitted in the window 172 in order to prevent the toner from leaking via the window 172.

To recycle the toner magazine 140, the cap member 156 is removed from the hole 154 against the elastic resistance of the larger diameter portion 156*b*. Then, the agitator 146 can be moved along the center line C of the shaft 148 in the removing direction (arrow D1). The hole 154 is substantially circular and has a radius slightly larger than the radius of rotation R of the agitating portion 150. Therefore, the agitator 146 can be passed through the hole 154 in the removing direction along the center line C of the shaft 148. Also, the elastic sheet 152 of the agitator 146 can be passed through the hole 154 by being bent inward along the edge of the hole 154. After the end 148*c* of the shaft 148 has been pulled out of the bearing portion 164, the agitator 146, elastic sheet 152 and seal ring 160 are pulled out of the toner tank 142 via the hole 154 Subsequently, the other cap member 168 is removed from the hole 166, and the inside of the toner tank 142 is cleaned by, e.g., blowing air.

In the above condition, expendable supplies including the elastic sheet 152 and seal ring 160 are replaced, as needed.

After the cleaning of the toner tank 142 and the replacement of supplies, the agitator 146 is positioned such that the center line C of the shaft 148 substantially coincides with the center of rotation defined by the bearing portion 164. Then, the agitator 146 is inserted into the toner tank 142 along the center line C in the inserting direction (arrow D2). At this instant, the agitator 146 and its elastic sheet 152 can be passed through the hole 154 for the previously stated reason. When the end 148*c* of the shaft 148 approaches the bearing portion 164, the operator can see the catch portion 148*d* of the shaft 148 through the window 172.

The operator, watching the end 148*c* of the shaft 148 through the window 172, inserts a jig, not shown, into the toner tank 142 via the hole 166. The jig has a hook-shaped end capable of hooking the catch portion 148*d*. The operator causes the jig to hook the catch portion 148*d*, and then pulls the jig outward. As a result, the end 148*c* of the shaft 148 is easily guided into the bearing portion 164 by the jig.

Subsequently, the operator releases the jig from the catch portion 148*d*, and then fits the cap members 168 and 156 in the holes 166 and 154, respectively. In this condition, the center line C of the shaft 148 is coincident with the center of rotation defined by the bearing portion 164 and cap member 156. Thereafter, a preselected amount of fresh toner is filled in the toner tank 142 via a toner inlet, not shown, completing the recycling operation. The waste toner tank formed integrally with the toner magazine 140, as well as the other sections, is recycled in the same manner as the above toner magazine 140. The whole CTM is recycled by the above procedure.

As stated above, the hole 154 is formed in the region of the toner tank 142 intersecting the center line C of the shaft 148. The hole 154 is so configured as to allow the agitator 146 to be passed therethrough along the center line C. In addition, the cap member 156 removably fitted in the hole 154 regulates the movement of the agitator 146 along the center line C. Therefore, only if the cap member 156 is removed from the hole 154, the agitator 146 can be removed from or inserted into the toner tank 142. When the cap member 156 is fitted in the hole 154, the agitator 146 is held in the preselected position in the toner tank 142. The toner magazine 140 therefore promotes the easy disassembly of the toner tank 142 and agitator 146.

Further, the toner tank 142 should only be formed with the hole 154 having an area just large enough to pass the agitator 146 This reduces the area of an opening necessarily formed in the toner tank 142 for assembly and disassembly. Consequently, the amount of a seal material including the seal ring 160 is reduced, and the operation for fitting a seal material is simplified.

The toner magazine 140 has the fresh toner tank 142 and waste toner tank constructed integrally with each other. Such a toner magazine 140 and therefore the entire CTM can be recycled rapidly at low cost.

10th Embodiment

In the ninth embodiment, the cap member 168 must be fitted in the hole 166 after the insertion of the end 148*c* of the shaft 148 into the hole 166, increasing the number of assembling steps. In addition, because the hole 154 has a substantial inside diameter, it is difficult to so produce or machine the cap member 156 as to eliminate a clearance between the edge of the hole 154 and the cap member 156, despite that the cap member 156 is formed of resin or similar material. Should the precision of the hole 154 and cap member 156 be maintained by severe quality control, the cost of the toner magazine 140 would increase. A tenth embodiment to be described with reference to FIG. 26 is a solution to these problems.

Figure 26:
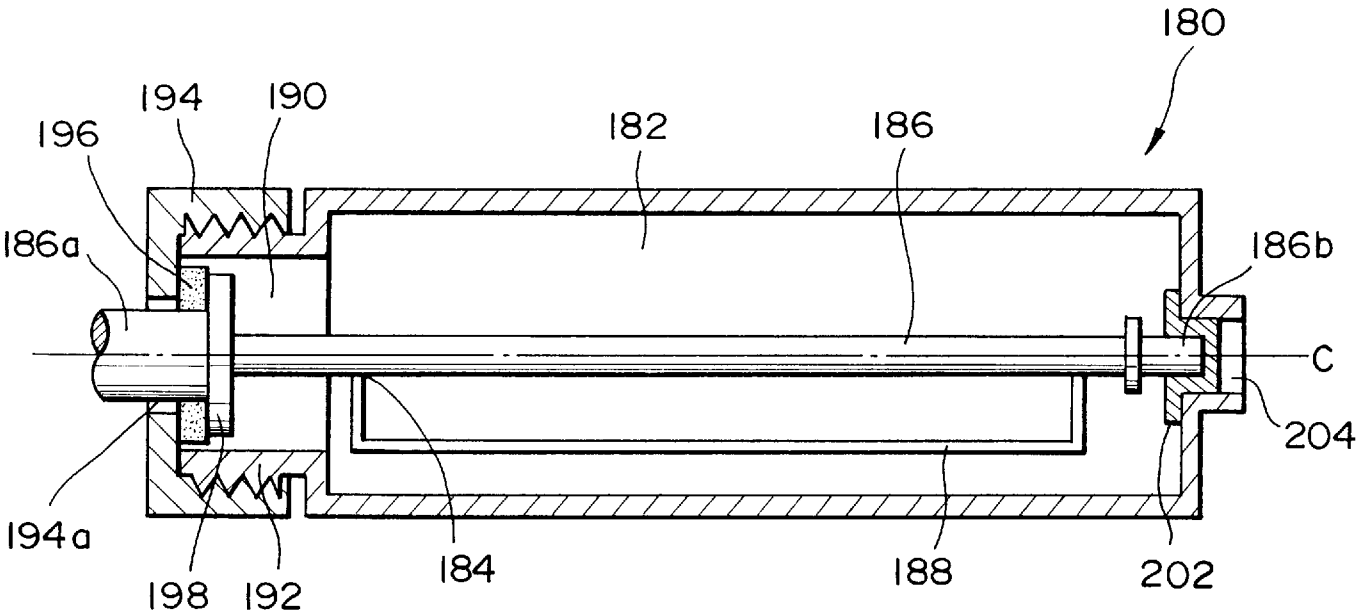
FIG. 26 is a section showing a toner magazine representative of a tenth embodiment of the present invention.

As shown in FIG. 26, a toner magazine 180 has a toner tank 182 storing fresh toner therein, and an agitator 184 disposed in the toner tank 182. The agitator 184 is made up of a single rotary shaft 186 rotatable within the toner tank 182, and an agitating portion 188 protruding radially outward from the shaft 186. A hole 190 is formed in one end wall of the toner tank 182. The toner tank 182 includes a cylindrical cap mounting portion 192 for affixing a cap member 194. The cap mounting portion 192 is formed with a male screw in its outer circumference whose center is defined by the hole 190. The cap member, resembling a cap nut, 194 is formed with a female screw in its inner circumference which is capable meshing with the male screw of the above portion 192 of the toner tank 182. When the cap member 194 is fitted on the portion 192 with its female screw mating with the male screw of the portion 192, the member 194 seals the hole 190. The male screw and female screw are implemented as tapered screws, so that pressure acting between them sequentially increases as the cap member 194 is sequentially screwed onto the portion 192.

A hole 194*a* is formed in the cap member 194. The end 186*a* of the shaft 186 is received in and rotatably supported by the hole 194*a*. A driven gear, not shown, is mounted on the end 186*a* of the shaft 186 protruding from the toner tank 182. The agitator 184 is operatively connected to a drive mechanism, not shown, via the driven gear.

The shaft 186 has a flange 198 compressing a seal ring 196 between it and the cap member 190 within the toner tank 182. The seal ring 196 prevents the toner from leaking to the outside of the toner tank 182 via the hole 194*a*. The direction in which the cap member 194 is screwed onto the cap mounting portion 192 is the same as the direction in which the agitator 184 rotates for agitating the toner. Therefore, the cap member 194 is prevented from being loosened by the rotation of the agitator 184; otherwise, the toner would leak via a gap between the loosened cap member 194 and the portion 192.

A hole 204 is formed in the other end of the toner tank 182 remote from the cap member 194. Another cap member 202 is mounted on the other end 186*b* of the shaft 186 and inserted into the hole 204 together with the end 186*b* from the inside of the toner tank 182, sealing the hole 204. The end 186*b* of the shaft 186 is rotatably supported by the cap member 202.

To recycle the toner magazine 180, the operator turns the cap member 194 in the loosening direction opposite to the screwing direction until the cap member 194 separates from the portion 192. As a result, the hole 190 is uncovered and allows the agitator 184 to be passed therethrough along the center line C of the shaft 186. The hole 190 is substantially circular and has an inside diameter larger than the sum of the diameter of the shaft 186 and the radial size of the agitating portion 188. Therefore, the agitator 184 can be pulled out of the toner tank 182 via the hole 190 along the center line C of the shaft 186. The seal ring 196 and the cap member 202 mounted on the end 186*b* of the shaft 186 can also be pulled out together with the agitator 184.

After the removal of the agitator 184, seal ring 196 and cap member 202 from the toner tank 182, the inside of the toner tank 182 is cleaned by, e.g., blowing air. The expendable supplies including the seal ring 196 and cap member 202 may be replaced, as needed.

Subsequently, the operator again inserts the agitator 184 into the toner tank 182 via the hole 190, and positions the agitator 184 within the toner tank 182 such that the center line C of the shaft 186 coincides with the center of rotation defined by the portion 192 and hole 204. Then, the operator moves the agitator 184 along the center line C until the cap member 202 on the end 186*b* of the shaft 186 has been received in the hole 204. Thereafter, the operator screws the cap member 194 onto the portion 192 in order to seal the hole 190. At this instant, the end 186*a* of the shaft 186 is received in the bearing hole 196*a* and rotatably supported by the cap member 194. Finally, a preselected amount of toner is filled in the toner tank 182.

As stated above, the female screw of the cap member 194 meshing with the male screw of the portion 192 seals the hole 190. In addition, the cap member 202 on the end 186*b* of the shaft 186 is received in the hole 204, sealing the hole 204. It follows that the cap member 194 and portion 192 can closely contact each other only if their female screw and male screw have a generally acceptable degree of precision. Specifically, even if the dimensional accuracy of the cap member 194 and portion 192 is far lower than the accuracy of the cap member 156 and hole 154 of the ninth embodiment, the toner is prevented from leaking to the outside via a clearance otherwise produced between the gap member 194 and the portion 192. This successfully reduces the cost of the seal structure using the cap member 194 and portion 192, compared to the cost of the seal structure using the cap member 156 and hole 154. Further, because the cap member 202 automatically seals the hole 204 when the agitator 184 is mounted to the toner tank 182, the operation for assembling of the toner magazine 180 is simplified.

Figure 27:
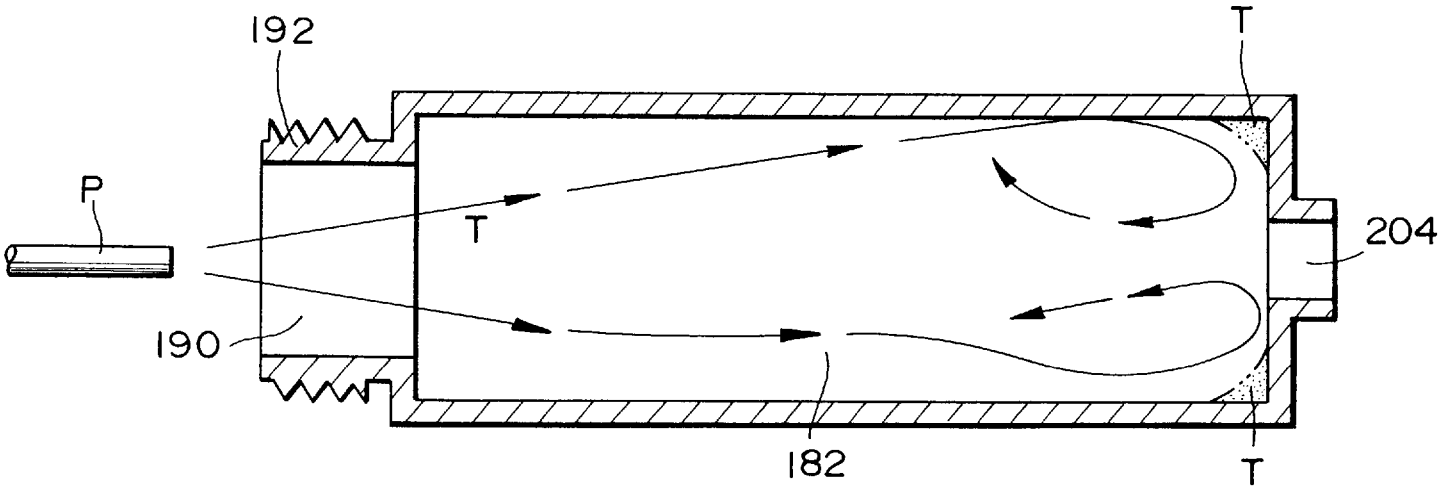
FIG. 27 demonstrates a specific method of cleaning a fresh toner tank included in the tenth embodiment.

A specific procedure for cleaning the inside of the toner tank 182 will be described with reference to FIG. 27. As shown, after the holes 190 and 204 have been uncovered, a pipe P is positioned to face the hole 190. Air under pressure is blown from the pipe P into the toner tank 182 via the hole 190. Specifically, a stream of air is sent into the toner tank 182 at a flow rate high enough to convey powdery toner. As a result, the toner T remaining in the toner tank 182 is conveyed to the outside of the toner tank 182 by the air stream. This kind of scheme allows most of the toner T left in the toner tank 182 to be discharged rapidly by simple operation. However, as shown in FIG. 27, the air stream cannot fully discharge a small amount of toner T staying around the hole 204. Specifically, the air stream stagnates at the corner portion around the hole 204 because the area of the hole 204 is smaller than the area of the hole 190 and the cross-sectional area of the toner tank 182 perpendicular to the axis. As a result, the outflow of the air via the hole 204 is reduced in amount and bounces off the wall of the hole 204.

Figure 28:
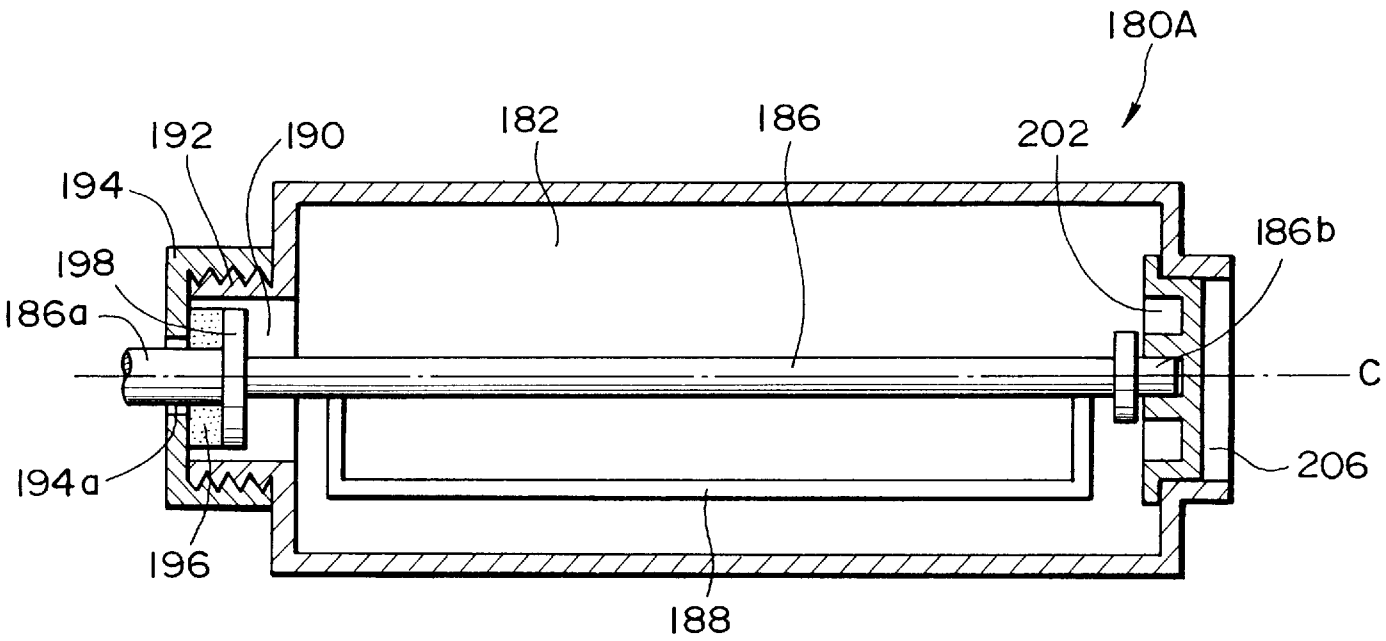
FIG. 28 is a section showing a modification of the tenth embodiment.

FIG. 28 shows a modification of the tenth embodiment capable of obviating the above defective cleaning. As shown, a toner magazine 180A includes a hole 206 sealed by the cap member 202. The hole 206 has an area substantially equal to or larger than the area of the hole 190. In addition, the ratio of the area of the hole 206 to the cross-sectional area of the toner tank 182 is reduced. With this configuration, it is possible to prevent the air stream from stagnating at the corner portion around the hole 206. Therefore, the air stream scheme described with reference to FIG. 27 is capable of substantially fully discharging the toner T from the toner tank 182. This saves time otherwise necessary for the remaining toner to be removed by, e.g., hand, and in addition insures a clean environment by allowing a minimum of toner from being blown out via the hole 190.

In summary, it will be seen that the present invention has various unprecedented advantages, as enumerated below.

(1) Since a fresh toner tank included in a CTM is movable to a developing unit, the construction is simplified, the size is reduced, and the space is saved. In addition, the tank can be provided with a great capacity.

(2) When the fresh toner tank is located in the vicinity of a waste toner tank, it is held in an unmovable state. In the event of replacement of the CTM, the two tanks can be returned to the position where they adjoin each other. Further, because the two tanks can be replaced in an integral configuration, maintenance is facilitated.

(3) The CTM can be mounted to an electrophotographic apparatus accurately in a predetermined position, simplifying maintenance.

(4) A contact charger, whose ability falls due to aging, can be replaced periodically with the waste toner tank included in the CTM.

(5) A charge roller, or contact charger, remains in contact with the surface of a photoconductive drum stably and uniformly and can, therefore, charge the drum uniformly. This can be done without exerting an extra load on the drum while the drum is in rotation.

(6) A toner left on the drum after image transfer can be collected stably over a long period of time only if the number of magnets carried on a magnetic body is so selected as to set up an adequate toner collecting ability.

(7) A toner magazine includes a developer storing body formed with a first hole in its region containing one point where it intersects the center line of a rotatable shaft. The first hole is so configured as to allow an agitating member to be passed therethrough along the center line of the shaft. A first cap member is removably fitted in the first hole in order to restrict the movement of the agitating member within the developer storing body. The cap member can be removed in order to pull the agitating member out of the developer storing body or to insert the former into the latter. In addition, the cap member retains the agitating member in a preselected position within the developer storing body when fitted in the hole. This simplifies the operation for assembling or disassembling the developer storing body and agitating member. Further, because the hole should only be sized to accommodate the agitating member, the opening of the developer storing body necessary for assembly and disassembly is reduced in area. Consequently, not only the amount of a seal material for obviating the leakage of a developer is reduced, but also the operation for fitting the seal material is simplified.

(8) The developer storing member includes a bearing portion for supporting one end of the shaft, and a window for allowing the operator to see the inside of the bearing portion. Therefore, the operator can insert the end of the shaft into the bearing portion while watching the bearing portion and the end of the shaft through the window. This facilitates the operation for mounting the agitating member to the developer storing body.

(9) The developer storing body further includes a second hole communicating the inside of the bearing portion to the outside at one end of the body, and a second cap removably fitted in the second hole. The end of the shaft supported by the bearing portion is formed with a catch portion to be hooked by a jig. When the jig is caused to hook the catch portion via the second hole and moved in the inserting direction, the end of the shaft is easily guided into the bearing portion. This further promotes the easy operation.

(10) The toner magazine can be recycled rapidly at low cost. Therefore, the entire CTM can be recycled by a rational procedure.

(11) A female screw formed in the first cap member meshes with a male screw formed in a cap mounting portion. The second cap member is mounted on the shaft and inserted into the second hole from the inside of the developer storing body so as to seal the second hole. It follows that the first cap member and cap mounting portion can closely contact each other only if their female screw and male screw have a generally acceptable degree of precision. Specifically, even if the dimensional accuracy of the cap member and cap mounting portion is lowered, the toner is prevented from leaking to the outside via a clearance otherwise produced between the cap member and the cap mounting portion. This successfully reduces the cost of the seal structure using the cap member and cap mounting portion. Further, because the second cap member automatically seals the second hole when the agitator is mounted to the developer storing body, the operation for assembling of the toner magazine is simplified.

(12) The direction in which the first cap member is screwed onto the cap mounting portion is the same as the direction in which the agitator rotates for agitating the toner. Therefore, the cap member is prevented from being loosened by the rotation of the agitator; otherwise, the toner would leak via a gap between the loosened cap member and the cap mounting portion.

(13) The second hole has an area sufficient for an air stream blown into the developer storing body at a flow rate capable of conveying a powdery developer to discharge the developer remaining in the body. Therefore, the developer can be substantially fully driven out of the developer storing body by such a simple air stream scheme. This makes it needless to remove the developer remaining around the second hole by, e.g., hand.

Various modifications will become possible for those skilled in the art after receiving the teachings of the present disclosure without departing from the scope thereof.

What is claimed is:

1. A cleaner and toner magazine (CTM) for replenishing a developing device of an electrophotographic apparatus with toner, comprising:

a waste toner tank for removing toner left on a photoconductive element of said electrophotographic apparatus after image transfer and collecting said toner;

a fresh toner tank having bosses and constructed integrally with said waste toner tank for replenishing said developing device with fresh toner; and a connector having support portions and integrally connecting said waste toner tank and said fresh toner tank such that said bosses of said fresh toner tank are supported by said support portions of said connector.

2. A CTM as claimed in claim 1, wherein said fresh toner tank is removable from said connector.

3. A CTM as claimed in claim 1, wherein said waste toner tank is removable from said connector.

4. A CTM as claimed in claim 1, wherein said bosses of said fresh toner tank are supported by said support portions of said connector with a play.

5. A CTM as claimed in claim 1, wherein said fresh toner tank has at least one guide member which cooperates with a guide rail of the electrophotographic apparatus for positioning said fresh toner tank in the electrophotographic apparatus.

6. A CTM as claimed in claim 1, wherein said connector comprises stepped plates each with an inner surface and an outer surface, said support portions of said connector each comprising seats which are formed on the inner surface of each of said stepped plates.

7. A CTM as claimed in claim 6, wherein a guide member is formed on the outer surface of at least one of said stepped plates and cooperates with a guide rail of the electrophotographic apparatus for positioning the CTM in the electrophotographic apparatus.

8. A CTM as claimed in claim 1, wherein said waste toner tank has at least one engaging portion configured so as to cooperate with a rotatable shaft of the photoconductive element of the electrophotographic apparatus for positioning said CTM in the electrophotographic apparatus.

9. A CTM as claimed in claim 1, wherein said waste toner tank has a handle.

10. A toner magazine removably mounted to an electrophotographic apparatus, comprising:

a developer storing body configured to store a developer therein;

an agitating member disposed in said developer storing body and mounted on a single rotatable shaft in said developer storing body, said agitating member being rotated by a driving force transmitted to said shaft from an outside of said developer storing body, while agitating the developer;

a first hole formed in a region of said developer storing body containing one point where said developer storing body intersects a center line of said shaft, said first hole being configured so as to allow said agitating member to pass therethrough along the center line of said shaft; and a first cap member removably fitted in said first hole for restricting a movement of said agitating member along the center line of said shaft when fitted, or allowing said agitating member to move along the center line of said shaft when removed.

11. A toner magazine as claimed in claim 10, wherein said developer storing body comprises a bearing portion supporting one end of said shaft remote from said first hole, and a window for allowing a region including said bearing portion to be seen from the outside.

12. A toner magazine as claimed in claim 11, further comprising:

a second hole formed in one end wall of said developer storing body along the center line of said shaft, and communicated to said bearing portion; and a second cap member removably fitted in said second hole for sealing said second hole when fitted or uncovering said second hole when removed;

said one end of said shaft being formed with a catch portion to be hooked by a jig which will be inserted into said developer storing body via said second hole during assembly.

13. A toner magazine removably mounted to an electrophotographic apparatus, comprising:

a developer storing body configured to store a developer therein;

an agitating member disposed in said developer storing body and mounted on a single rotatable shaft in said developer storing body, said agitating member being rotated by a driving force transmitted to said shaft from an outside of said developer storing body, while agitating the developer;

a first hole formed in a region of said developer storing body containing one point where said developer storing body intersects a center line of said shaft, said first hole being configured so as to allow said agitating member to pass therethrough along the center line of said shaft;

a second hole formed in a region of said developer storing body containing another point where said developer storing body intersects the center line of said shaft;

a hollow cylindrical cap mounting portion formed at an end of said developer storing body around said first hole and formed with a male screw on an outer circumference thereof;

a first cap member in a form of a cap nut and formed with a female screw engageable with said male screw in an inner circumference thereof, said first cap member sealing said first hole when mounted to said cap mounting portion or uncovering said first hole when removed from said cap mounting portion; and a second cap member mounted on an end of said shaft remote from said first hole for sealing said second hole when inserted into said second hole from an inside of said developer storing body.

14. A toner magazine as claimed in claim 13, wherein said second hole has an area configured to discharge, when a stream of air is blown into said developer storing body via said first hole at a flow rate configured to convey a powdery developer, the powdery developer remaining in said developer storing body via said second hole.

15. A toner magazine as claimed in claim 13, wherein said first cap member is screwed onto said cap mounting portion in a same direction as a direction in which said agitating member rotates for agitating the developer.

16. A toner magazine as claimed in claim 15, wherein said second hole has an area configured to discharge, when a stream of air is blown into said developer storing body via said first hole at a flow rate configured to convey a powdery developer, the powdery developer remaining in said developer storing body via said second hole.

17. A CTM removably mounted to an electrophotographic apparatus, comprising:

a toner magazine storing a developer therein and for feeding the developer to a developing device included in said electrophotographic apparatus for developing a latent image electrostatically formed on a photoconductive element; and a waste toner tank constructed integrally with said toner magazine for collecting the developer removed from the photoconductive element;

said toner magazine comprising:

a developer storing body storing a developer therein;

an agitating member disposed in said developer storing body and mounted on a single rotatable shaft in said developer storing body, said agitating member being rotated by a driving force transmitted to said shaft from an outside of said developer storing body, while agitating the developer;

a first hole formed in a region of said developer storing body containing one point where said developer storing body intersects a center line of said shaft, said first hole being so configured as to allow said agitating member to pass therethrough along the center line of said shaft; and a first cap member removably fitted in said first hole for restricting a movement of said agitating member along the center line of said shaft when fitted, or allowing said agitating member to move along the center line of said shaft when removed.

18. A CTM as claimed in claim 17, wherein said developer storing body comprises a bearing portion supporting one end of said shaft remote from said first hole, and a window for allowing a region including said bearing portion to be seen from outside.

19. A CTM as claimed in claim 18, further comprising:

a second hole formed in one end wall of said developer storing body along the center line of said shaft, and extending into said bearing portion; and a second cap member removably fitted in said second hole for sealing said second hole when fitted or uncovering said second hole when removed;

said one end of said shaft being formed with a catch portion to be hooked by a jig which will be inserted into said developer storing body via said second hole during assembly.

20. A CTM removably mounted to an electrophotographic apparatus, comprising:

a toner magazine storing a developer therein and for feeding the developer to a developing device included in said electrophotographic apparatus for developing a latent image electrostatically formed on a photoconductive element; and a waste toner tank constructed integrally with said toner magazine for collecting the developer removed from the photoconductive element;

said toner magazine comprising;

a developer storing body storing a developer therein;

an agitating member disposed in said developer storing body and mounted on a single rotatable shaft in said developer storing body, said agitating member being rotated by a driving force transmitted to said shaft from an outside of said developer storing body, while agitating the developer;

a first hole formed in a region of said developer storing body containing one point where said developer storing body intersects a center line of said shaft, said first hole being configured so as to allow said agitating member to pass therethrough along the center line of said shaft;

a second hole formed in a region of said developer storing body containing another point where said developer storing body intersects the center line of said shaft;

a hollow cylindrical cap mounting portion formed at an end of said developer storing body around said first hole and formed with a male screw on an outer circumference thereof;

a first cap member in a form of a cap nut and formed with a female screw engageable with said male screw in an inner circumference thereof, said first cap member sealing said first hole when mounted to said cap mounting portion or uncovering said first hole when removed from said cap mounting portion; and a second cap member mounted on an end of said shaft remote from said first hole for sealing said second hole when inserted into said second hole from an inside of said developer storing body.

21. A CTM as claimed in claim 20, wherein said second hole has an area configured to discharge, when a stream of air is blown into said developer storing body via said first hole at a flow rate configured to convey a powdery developer, the powdery developer remaining in said developer storing body via said second hole.

22. A CTM as claimed in claim 20 wherein said first cap member is screwed onto said cap mounting portion in a same direction as a direction in which said agitating member rotates for agitating the developer.

23. A CTM as claimed in claim 22, wherein said second hole has an area configured to discharge, when a stream of air is blown into said developer storing body via said first hole at a flow rate configured to convey a powdery developer, the powdery developer remaining in said developer storing body via said second hole.

* * * * *